US010805720B2

(12) United States Patent
Fontana et al.

(10) Patent No.: US 10,805,720 B2
(45) **Date of Patent: *Oct. 13, 2020**

(54) AUDIO SIGNAL PROCESSING APPARATUS AND A SOUND EMISSION APPARATUS

(71) Applicants: Huawei Technologies Co., Ltd., Shenzhen (CN); University of Southampton, Southampton (GB)

(72) Inventors: Simone Fontana, Munich (DE); Yue Lang, Beijing (CN); Filippo Fazi, Southampton (GB); Mincheol Shin, Southampton (GB); Ferdinando Oliveri, Southampton (GB)

(73) Assignees: Huawei Technologies Co., Ltd., Shenzhen (CN); University of Southampton, Southampton (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/435,332

(22) Filed: Jun. 7, 2019

(65) Prior Publication Data

US 2019/0342656 A1 Nov. 7, 2019

Related U.S. Application Data

(63) Continuation of application No. 15/894,485, filed on Feb. 12, 2018, now Pat. No. 10,405,089, which is a continuation of application No. PCT/EP2015/068706, filed on Aug. 13, 2015.

(51) Int. Cl.

| | |
|---|---|
| ***H04R 1/40*** | (2006.01) |
| ***H04R 5/02*** | (2006.01) |
| ***H04R 3/12*** | (2006.01) |

(52) U.S. Cl.

CPC ..... *H04R 1/403* (2013.01); *H04R 3/12* (2013.01); *H04R 5/02* (2013.01);

(Continued)

(58) Field of Classification Search

CPC ... H04R 5/02; H04R 1/02; H04R 1/26; H04R 1/24

(Continued)

(56) References Cited

U.S. PATENT DOCUMENTS

| | | | |
|---|---|---|---|
| 6,016,353 | A | 1/2000 | Gunness |
| 9,485,556 | B1 | 11/2016 | List |

(Continued)

FOREIGN PATENT DOCUMENTS

| | | | |
|---|---|---|---|
| CN | 101431710 | A | 5/2009 |
| EP | 1061769 | A2 | 12/2000 |

(Continued)

OTHER PUBLICATIONS

Kolundzija et al., "Design of a Compact Cylindrical Loudspeaker Array for Spatial Sound Reproduction," AES 130th Convention, London, UK, pp. 1-10, Audio Engineering Society (2011).

(Continued)

*Primary Examiner* — Alexander Krzystan

(74) *Attorney, Agent, or Firm* — Leydig, Voit & Mayer, Ltd.

(57) ABSTRACT

The disclosure relates to an audio signal processing apparatus for processing an input audio signal, comprising a filter unit comprising a plurality of filters, each filter configured to filter the input audio signal to obtain a plurality of filtered audio signals, each filter designed according to an extended mode matching beamforming applied to a surface of a half revolution, the surface partially characterizing a loudspeaker enclosure shape, a plurality of scaling units, each scaling unit configured to scale the plurality of filtered audio signals using a plurality of gain coefficients to obtain a plurality of scaled filtered audio signals, and a plurality of adders, each adder configured to combine the plurality of scaled filtered audio signals, thereby providing an output audio signal for producing a sound field having a beam directivity pattern defined by the plurality of gain coefficients.

7 Claims, 12 Drawing Sheets

(52) U.S. Cl.
CPC .. *H04R 2201/021* (2013.01); *H04R 2201/401* (2013.01); *H04R 2203/12* (2013.01); *H04R 2205/024* (2013.01)

(58) Field of Classification Search
USPC ..... 381/335, 336, 425, 430, 300, 308, 395
See application file for complete search history.

(56) References Cited

U.S. PATENT DOCUMENTS

| | | | | |
|---|---|---|---|---|
| 2007/0076905 | A1 | 4/2007 | Konagai et al. | |
| 2007/0269071 | A1 | 11/2007 | Hooley | |
| 2011/0038494 | A1 | 2/2011 | Graber | |
| 2012/0020480 | A1 | 1/2012 | Visser | |
| 2013/0058505 | A1 | 3/2013 | Munch | |
| 2013/0142337 | A1 | 6/2013 | Troughton et al. | |
| 2013/0223658 | A1* | 8/2013 | Betlehem ..... | H04R 5/02 381/307 |

FOREIGN PATENT DOCUMENTS

| | | | |
|---|---|---|---|
| EP | 1699259 | A1 | 9/2006 |
| JP | 2005191851 | A | 7/2005 |
| JP | 2006109343 | A | 4/2006 |
| WO | 2008010086 | A2 | 1/2008 |
| WO | 2011144499 | A1 | 11/2011 |

OTHER PUBLICATIONS

Moller et al., "Circular Loudspeaker Array with Controllable Directivity," AES 128th Convention, London, UK, pp. 1-12 Audio Engineering Society (May 22-25, 2010).

Teutsch et al., "Acoustic source detection and localization based on wavefield decomposition using circular microphone arrays," Journal of the Acoustical Society of America, vol. 120, No. 5, pp. 2724-2736, Acoustical Society of America (Nov. 2006).

Shin et al., "Controlled sound field with a dual layer loudspeaker array," J. Sound Vib., 333(16): 3794-3817, Elsevier Ltd., (2014).

Chang et al., "Sound field control with a circular double-layer array of loudspeakers," J. Acoust. Soc. Am., 131(6):4518, Acoustical Society of America, (Jun. 2012).

Colton et al., "Inverse Acoustic and Electromagnetic Scattering Theory," Inside Out: Inverse Problems, MSRI Publications vol. 47, pp. 67-110, 2003.

Nawfal et al., "Perceptual Evaluation of Loudspeaker Binaural Rendering Using a Linear Array,"137th Convention of AES, Convention Paper 9151, Audio Engineering Society (Oct. 9-12, 2014).

Shin et al., Maximization of acoustic energy difference between two spaces; J. Acoust. Soc. Am., 128(1 ): 121-131, Acoustical Society of America (2010).

Choi et al.,"Generation of an acoustically bright zone with an illuminated region using multiple sources," J. Acoust. Soc. Am., 111(4): 1695, Acoustical Society of America (2002).

Cai et al., "Sound reproduction in personal audio systems using the leastsquares approach with acoustic contrast control constraint," J. Acoust. Soc. Am., 135(2):734-741, Acoustical Society of America (2014).

Galvez et al.,"A superdirective array of phase shift sources". J. Acoust. Soc. Am., 132(2): 746-56, Acoustical Society of America (2012).

Poletti et al., "Design of a Prototype Variable Directivity Loudspeaker for Improved Surround Sound Reproduction in Rooms," in 52nd International AES Conference, Audio Engineering Society (Sep. 2-4, 2013).

* cited by examiner

AUDIO SIGNAL PROCESSING APPARATUS AND A SOUND EMISSION APPARATUS

CROSS-REFERENCE TO RELATED APPLICATIONS

This application is a continuation of U.S. patent application Ser. No. 15/894,485, filed on Feb. 12, 2018, which is a continuation of International Application No. PCT/EP2015/068706, filed on Aug. 13, 2015. All of the afore-mentioned patent applications are hereby incorporated by reference in their entireties.

TECHNICAL FIELD

Embodiments of the present disclosure relate to the field of audio signal processing. In particular, the present disclosure relates to an audio signal processing apparatus and a sound emission apparatus comprising a transducer array.

BACKGROUND

Different configurations and shapes of transducer or loudspeaker arrays for outputting one or more audio signals are known from the related art. WO2011/144499 A1, for instance, discloses a circular loudspeaker array mounted on a cylindrical body. By processing the audio signal in a suitable manner the directivity of the circular loudspeaker array disclosed in WO2011/144499 A1 can be controlled. This process is usually called beamforming.

In the majority of cases, for circular and spherical loudspeaker arrays, beamforming is based on the so-called "mode-matching" approach. The objective is to generate a sound beam with a circular loudspeaker array mounted on a cylindrical body. The array consists of L loudspeakers flush-mounted on the surface of a rigid (ideally infinite) cylinder at the same height. The angular spacing between loudspeakers is assumed to be uniform. The signal $q_l(w)$ driving the l-th loudspeaker at angular coordinate $\phi_l$, that is required to generate a sound beam steered towards direction $\phi_0$, is given by the following expression (in the frequency domain):

$$q_l(\omega)=X(\omega)E_{n=-N}^{N}e^{in(\phi_l-\phi_0)}C_n(\omega), \quad (1)$$

where $X(\omega)$ is the mono audio input signal associated with the sound beam, N is a parameter that controls the width of the beam, i is the imaginary unit and $C_n(\omega)$ is a frequency dependent function that depends on the radius of the cylinder and on the characteristic of the loudspeakers. The coefficients $C_n(\omega)$ are generally obtained from the analytical expression of the sound field radiated by a rectangular piston on an infinite and rigid cylindrical baffle (M. Kolundzija, C. Faller, and M. Vetterli, "Design of a Compact Cylindrical Loudspeaker Array for Spatial Sound Reproduction", AES 130th Conv., 2011; M. Moller, M. Olsen, F. Agerkvist, J. Dyreby, and G. Munch, "Circular loudspeaker array with controllable directivity", in Audio Engineering Society Convention 128, 2010). A more advanced but similar expression was derived that accounts also for the finite height of the rigid cylinder (H. Teutsch and W. Kellermann, "Acoustic source detection and localization based on wavefield decomposition using circular microphone arrays", Journal of the Acoustical Society of America, vol. 120, pp. 2724-2736, November 2006).

SUMMARY

It is an object of the disclosure to provide an innovative audio signal processing apparatus fitting an innovative sound emission apparatus.

The foregoing and other objects are achieved by the subject matter of the independent claims. Further implementation forms are apparent from the dependent claims, the description and the figures.

According to a first aspect, an audio signal processing apparatus for processing an input audio signal is provided, comprising a filter unit comprising a plurality of filters, each filter configured to filter the input audio signal to obtain a plurality of filtered audio signals, each filter designed according to an extended mode matching beamforming applied to a surface of a half revolution, the surface partially characterizing a loudspeaker enclosure shape, a plurality of scaling units, each scaling unit configured to scale the plurality of filtered audio signals using a plurality of gain coefficients to obtain a plurality of scaled filtered audio signals, and a plurality of adders, each adder configured to combine the plurality of scaled filtered audio signals, thereby providing an output audio signal for producing a sound field having a beam directivity pattern defined by the plurality of gain coefficients. A surface of a half revolution is defined by rotating a generatrix by 180° around a straight line, i.e. an axis, in the plane of the generatrix. In case of a generatrix in the form of a straight line running parallel to the axis the surface of a half revolution is the outer surface of a half cylinder. Herein extended mode matching beamforming is defined as an extension of conventional mode matching beamforming to such a surface of a half revolution.

Thus, an innovative audio signal processing apparatus is provided.

In a first possible implementation form of the audio signal processing apparatus according to the first aspect, the impulse response of an n-th filter of the plurality of filters is defined by the following equation or an equation derived therefrom:

$$R_n(t) = F^{-1}\left[\frac{1}{\Gamma_n(r,\omega)}\right],$$

wherein $F^{-1}$ denotes the inverse Fourier transformation, $\Gamma_n$ characterizes, as a function of radial distance r and frequency ω, an n-th order coefficient of a Fourier series describing a radiation polar pattern of a transducer array conforming to the curvature of a surface of full revolution comprising the surface of the half revolution, the n-th order coefficient is dependent on the loudspeaker enclosure shape, and $R_n(t)$ denotes the impulse response of the n-th filter as a function of time.

In a second possible implementation form of the audio signal processing apparatus according to the first implementation form the impulse response of the n-th filter is defined by the following equation or an equation derived therefrom:

$$R_n(t) = F^{-1}\left[\frac{\Gamma_n(r,\omega)^*}{|\Gamma_n(r,\omega)|^2+\beta_n(\omega)}\right],$$

wherein $\beta_n$ denotes a definable regularization parameter (which is generally frequency dependent).

In a third possible implementation form of the audio signal processing apparatus according to the first or the second implementation form of the first aspect of the disclosure, $\Gamma_n$, is defined by the following equation or an equation derived therefrom:

$$\Gamma_n=2i^{-n}b_n(kR),$$

wherein the function $b_n(kR)$ is defined by the following equation or an equation derived therefrom:

$$b_n(\xi) = \frac{2i}{\pi\xi H_n'(\xi)},$$

wherein $\xi$ denotes the product kR, k denotes the wave number, R denotes the radius of the surface of the half revolution and $H_n'$ denotes a derivative of the n-th order Hankel function.

In a fourth possible implementation form of the audio signal processing apparatus according to any one of the first to third implementation form of the first aspect of the disclosure, the output audio signal for the l-th transducer of the transducer array is defined by the following equation or an equation derived therefrom:

$$z_l(t)=E_{n=0}^{L-1}[x(t)\otimes R_n(t)]G_{n,l},$$

wherein $z_l(t)$ denotes the output signal as a function of time, x(t) denotes the input audio signal as a function of time, $\otimes$ denotes the convolution operator, where n can range from 0 to N and N depends on the beam directivity pattern, and $G_{n,l}$ denotes the n-th gain coefficient for the l-th transducer.

In a fifth possible implementation form of the audio signal processing apparatus according to the fourth implementation form of the first aspect, the n-th gain coefficient for the l-th transducer of the transducer array is defined by the following equation or an equation derived therefrom:

$$G_{n,l} = \frac{\sqrt{2-\delta_n}}{L}\cos(n\phi_l)f_n,$$

wherein $\delta_n$ denotes the Kronecker delta being equal to 1 if n=0 and equal to 0 otherwise, L denotes the number transducers of the transducer array, $\phi_l$ denotes the angular coordinate that identifies the position of the l-th transducer of the transducer array and $f_n$ characterizes the n-th coefficient of the Fourier series or Fourier cosine series describing a desired beam directivity pattern as a function of the radiation angle.

In a sixth possible implementation form of the audio signal processing apparatus according to the fifth implementation form of the first aspect of the disclosure, the beam directivity pattern is a single beam in a direction defined by an angle $\phi_0$ and wherein the n-th directivity coefficient $f_n$ is defined by the following equation or an equation derived therefrom:

$$f_n=\sqrt{2-\delta_n}\gamma(\phi_0)\cos(n\phi_0),$$

wherein $\gamma(\phi_0)$ is an angular dependent factor given by the following equation or an equation derived therefrom:

$$\gamma(\phi_0) = \frac{1}{\sum_{n=0}^{N}(2-\delta_n)\cos(n\phi_0)^2}.$$

In a seventh possible implementation form of the audio signal processing apparatus according to any one of the fourth to sixth implementation form of the first aspect of the disclosure, the beam directivity pattern is defined by multiple beams in respective directions defined by a respective angle $\phi_j$ and wherein the output audio signal $z_l(t)$ for the l-th transducer of the transducer array is given by the following equation or an equation derived therefrom:

$$z_l(t)=\Sigma_{n=0}^{L-1}\Sigma_{j=1}^{J}[x(t)\otimes R_n(t)\otimes\delta(t-\tau_j)K_j]G_{n,l}(\phi_j),$$

wherein J denotes the total number of beams of the beam directivity pattern, $\tau_j$ denotes the time delay for the j-th beam and $K_j$ denotes the gain for the j-th beam.

In an eighth possible implementation form of the audio signal processing apparatus according to the first aspect as such or according to any one of the preceding implementation forms, the filter unit, the plurality of scaling units and the plurality of adders are configured to process at least two audio input audio signals, thereby providing a stereo output audio signal for producing a stereo sound field having the beam directivity pattern defined by the plurality of gain coefficients.

In a ninth possible implementation form of the audio signal processing apparatus according to the first aspect as such or according to any one of the preceding implementation forms, the filter unit, the plurality of scaling units and the plurality of adders are further configured to provide a further output audio signal for producing a further sound field, via a half axisymmetric loudspeaker array, having a further beam directivity pattern defined by the plurality of gain coefficients.

In a tenth possible implementation form of the audio signal processing apparatus according to the first aspect as such or according to any one of the preceding implementation forms, the audio signal processing apparatus further comprises a bass enhancement unit, wherein the bass enhancement unit is configured to process each audio input signal individually upstream of the filter unit, the plurality of scaling units, and the plurality of adders.

In an eleventh possible implementation form of the audio signal processing apparatus according to the first aspect as such or according to any one of the preceding implementation forms, the audio signal processing apparatus further comprises a filter network for dividing the input audio signal into two or more divided input audio signals of differing frequency bandwidths, thereby providing at least a first and second input audio signal, and a further filter unit, a further plurality of scaling units, and a further plurality of adders for processing the second input audio signal, thereby providing a second output audio signal for producing the sound field having the beam directivity pattern defined by the plurality of gain coefficients.

According to a second aspect, a sound emission apparatus is provided comprising a loudspeaker enclosure comprising a sound emission section and a rear section, wherein the sound emission section is coupled to or integral with the rear section and the sound emission section generally defines a surface of a half revolution about an axis extending along a length of the loudspeaker enclosure, and at least one transducer array mounted on the sound emission section of the loudspeaker enclosure, wherein a plane passing through the transducer array is orthogonal to the axis, the at least one transducer array being curved such that the at least one transducer array conforms to the curvature of the surface of the half revolution. Alternatively, the sound emission apparatus comprises a loudspeaker enclosure comprising a sound emission section and a rear section, wherein the sound emission section is coupled to or integral with the rear section and the sound emission section generally defines a surface of a half revolution about an axis extending along a length of the loudspeaker enclosure, and at least one transducer array mounted within the loudspeaker enclosure and connected to an array of waveguides defining an array of sound emission ports in the sound emission section of the loudspeaker enclosure, wherein a plane passing through the array of sound emission ports is orthogonal to the axis, the array of sound emission ports being curved such that the array of sound emission ports conforms to the curvature of the surface of the half revolution.

Thus, an innovative sound emission apparatus is provided.

In a first possible implementation form of the sound emission apparatus according to the second aspect of the disclosure, the at least one transducer array substantially spans the width of the sound emission section.

In a second possible implementation form of the sound emission apparatus according to the second aspect of the disclosure as such or according to the first implementation form thereof, the sound emission section defines an aperture for mounting the at least one transducer array.

In a third possible implementation form of the sound emission apparatus according to the second aspect of the disclosure as such or according to the first or second implementation form thereof, the loudspeaker enclosure generally defines a half axis-symmetric shape.

In a fourth possible implementation form of the sound emission apparatus according to the second aspect of the disclosure as such or according to any one of the first to third implementation form thereof, the loudspeaker enclosure generally defines one of a half-cylindrical shape or a half-conical shape.

In a fifth possible implementation form of the sound emission apparatus according to the third or fourth implementation form of the second aspect of the disclosure, the sound emission apparatus comprises a further loudspeaker enclosure that generally defines the half axis-symmetric shape, the further loudspeaker enclosure comprising a sound emission section and a rear section, wherein the sound emission section is coupled to or integral with the rear section and the sound emission section generally defines a further surface of the half revolution about a further axis extending along a length of the further loudspeaker enclosure, and at least one further transducer array mounted on the sound emission section of the further loudspeaker enclosure, wherein a further plane passing through the further transducer array is orthogonal to the further axis, the at least one further transducer array being curved such that the at least one further transducer array conforms to the curvature of the further surface of the half revolution, wherein the rear section of the further loudspeaker enclosure is configured to be coupled to the rear section of the loudspeaker enclosure thereby generally defining an axis-symmetric shape or at least one further transducer array mounted within the further loudspeaker enclosure and connected to a further array of waveguides defining a further array of sound emission ports in the sound emission section of the further loudspeaker enclosure, wherein a further plane passing through the further array of sound emission ports is orthogonal to the further axis, the further array of sound emission ports being curved such that the further array of sound emission ports conforms to the curvature of the further surface of the half revolution.

In a sixth possible implementation form of the sound emission apparatus according to the second aspect as such or according to any one of the first to fifth implementation form thereof, the at least one transducer array comprises a first transducer array and a second transducer array, wherein a first plane passing through the first transducer array is orthogonal to the axis, a second plane passing through the second transducer array is orthogonal to the axis, and the first and second planes are parallel to each other.

In a seventh possible implementation form of the sound emission apparatus according to the sixth implementation form of the second aspect of the disclosure, the positions of the transducers of the first transducer array have an angular offset relative to the positions of the transducers of the second transducer array.

In an eighth possible implementation form of the sound emission apparatus according to the seventh implementation form of the second aspect of the disclosure, the angular offset is about half of the angular spacing between neighboring transducers of the first transducer array.

In a ninth possible implementation form of the sound emission apparatus according to the second aspect of the disclosure as such or according to any one of the first to eighth implementation form thereof, the sound emission apparatus further comprises an audio signal processing apparatus according to the first aspect of the disclosure as such or according to any one of the first to eleventh implementation form thereof.

BRIEF DESCRIPTION OF THE DRAWINGS

Further embodiments of the disclosure will be described with respect to the following figures, in which.

As far as possible, identical reference signs have been used in the different figures for identical or at least functionally equivalent features.

DETAILED DESCRIPTION OF EMBODIMENTS

In the following detailed description, reference is made to the accompanying drawings, which form a part of the disclosure, and in which are shown, by way of illustration, specific aspects in which the present disclosure may be practiced. It is understood that other aspects may be utilized and structural or logical changes may be made without departing from the scope of the present disclosure. The following detailed description, therefore, is not to be taken in a limiting sense, as the scope of the present disclosure is defined by the appended claims. For instance, it is understood that the features of the various exemplary aspects described herein may be combined with each other, unless specifically noted otherwise.

Figure 1:
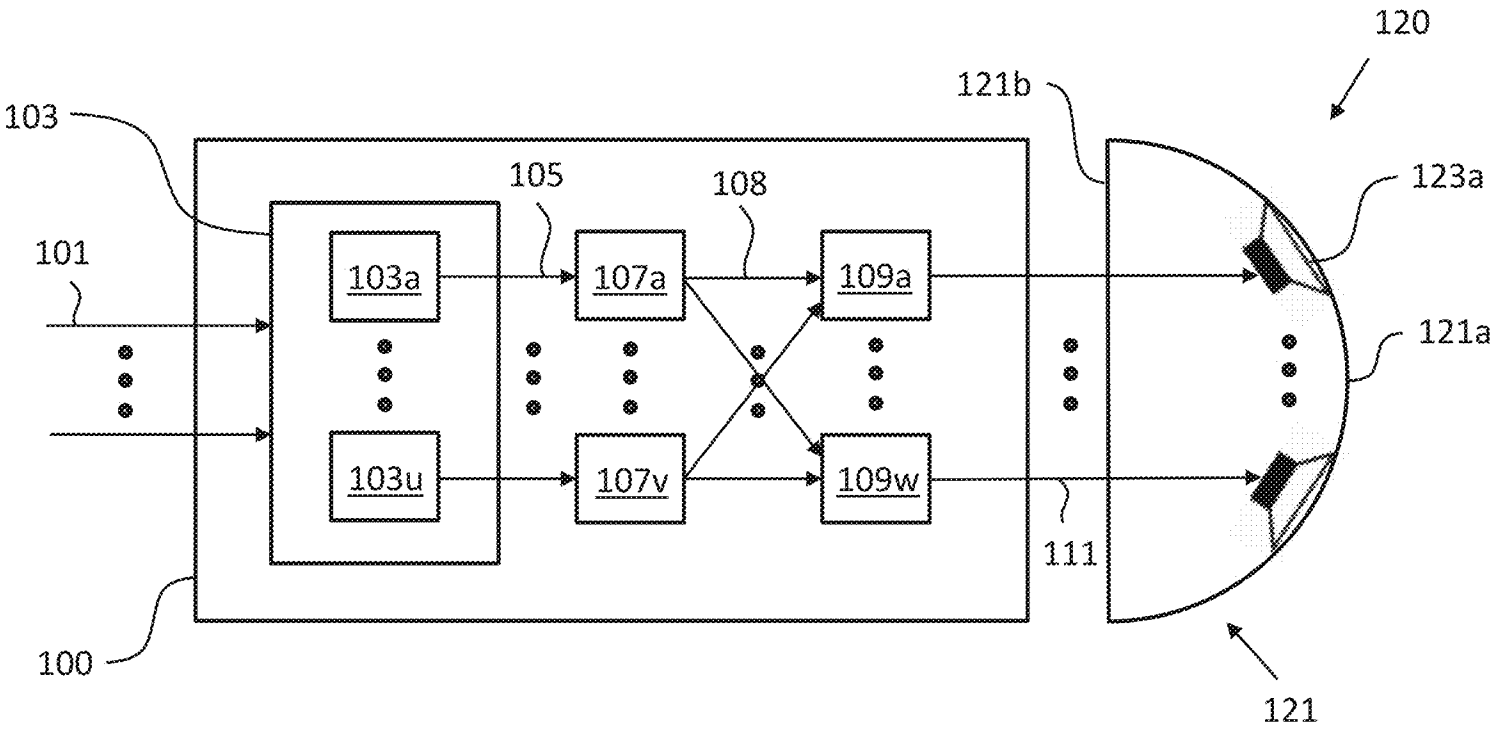
FIG. 1 shows a schematic diagram illustrating an audio signal processing apparatus according to an embodiment and a sound emission apparatus according to an embodiment.

FIG. 1 shows schematically an audio signal processing apparatus 100 according to an embodiment.

The audio signal processing apparatus 100 is configured to process an input audio signal 101. As indicated in FIG. 1, the input audio signal 101 can comprise more than one input audio signal or channel, for instance, the left channel and the right channel of a stereo input audio signal.

The audio signal processing apparatus 100 comprises a filter unit 103 having a plurality of filters 103*a-u*. The filters 103*a-u* of the filter unit 103 are configured to filter the input audio signal 101 to obtain a plurality of filtered audio signals 105 and are designed according to an extended mode matching beamforming applied to a surface of a half revolution, wherein the surface partially characterizes the shape of a loudspeaker enclosure, such as the loudspeaker enclosure 121 shown in FIG. 1. A surface of a half revolution is defined by rotating a generatrix by 180° around a straight line, i.e. an axis, in the plane of the generatrix. In case of a generatrix in the form of a straight line running parallel to the axis the surface of a half revolution is the outer surface of a half cylinder. Herein extended mode matching beamforming is defined as an extension of conventional mode matching beamforming to such a surface of a half revolution.

The audio signal processing apparatus 100 further comprises a plurality of scaling units 107*a-v*, wherein each scaling unit 107*a-v* is configured to scale the plurality of filtered audio signals 105 (provided by the filter unit 103) using a plurality of gain coefficients to obtain a plurality of scaled filtered audio signals 108.

The audio signal processing apparatus 100 further comprises a plurality of adders 109*a-w*, wherein each adder 109*a-w* is configured to combine the plurality of scaled filtered audio signals 108, thereby providing an output audio signal 111 for producing a sound field having a beam directivity pattern defined by the plurality of gain coefficients. As indicated in FIG. 1, the output audio signal 111 can generally comprise a plurality of output audio signals. In an embodiment, each adder 109*a-w* can be configured to add the plurality of scaled filtered audio signals 108. In an embodiment, each adder 109*a-w* can be configured to combine the plurality of scaled filtered audio signals 108 for providing a respective output signal 111 to each transducer of a transducer array, for instance, the transducer array 123 shown in FIG. 1. Generally, the number of transducers corresponds to the numbers of adders 109*a-w*.

FIG. 1, furthermore, shows schematically a sound emission apparatus 120 in communication with the audio signal processing apparatus 100. Although shown as a separate component in FIG. 1, in an embodiment the audio signal processing apparatus 100 can be part of the sound emission apparatus 120.

The sound emission apparatus 120 comprises a loudspeaker enclosure 121 having a sound emission section 121*a* and a rear section 121*b*, wherein the sound emission section 121*a* is coupled to or integral with the rear section 121*b*. Generally, the sound emission section 121*a* defines a surface of a half revolution about an axis extending along a length of the loudspeaker enclosure 121. In the schematic diagram of FIG. 1 this axis runs normal to the plane defined by FIG. 1.

Moreover, the sound emission apparatus 120 comprises at least one transducer array 123*a* comprising a plurality of transducers or loudspeakers that can be mounted on the sound emission section 121*a* of the loudspeaker enclosure 121, wherein a plane passing through the transducer array 123*a* is orthogonal to the axis. In the schematic diagram of FIG. 1, the plane passing through the transducer array 123*a* coincides with the plane defined by FIG. 1. As indicated in FIG. 1, the transducer array 123*a* is curved such that the transducer array 123*a* conforms to the curvature of the surface of the half revolution.

In an embodiment, the transducers of the transducer array 123*a* can be flush-mounted on the surface of the sound emission section 121*a* of the loudspeaker enclosure 121. To this end, in an embodiment one or more apertures can be provided in the sound emission section 121*a* of the loudspeaker enclosure 121 for accommodating the transducer array 123*a*. In an embodiment of the sound emission apparatus 120, further apertures can be provided in the loudspeaker enclosure 121 providing, for instance, for acoustic vents.

In an embodiment, the transducers of the transducer array 123*a* can be combined with waveguides integrated in the sound emission apparatus 120. In this embodiment, each transducer of the transducer array 123*a* can be mounted in the interior of the loudspeaker enclosure 121 and a waveguide can connect a diaphragm of each transducer with a sound emission port on the sound emission section 121*a*, i.e. with the exterior of the sound emission apparatus 120.

In the following, further implementation forms, embodiments and aspects of the audio signal processing apparatus 100 and the sound emission apparatus 120 will be described.

Figure 2:
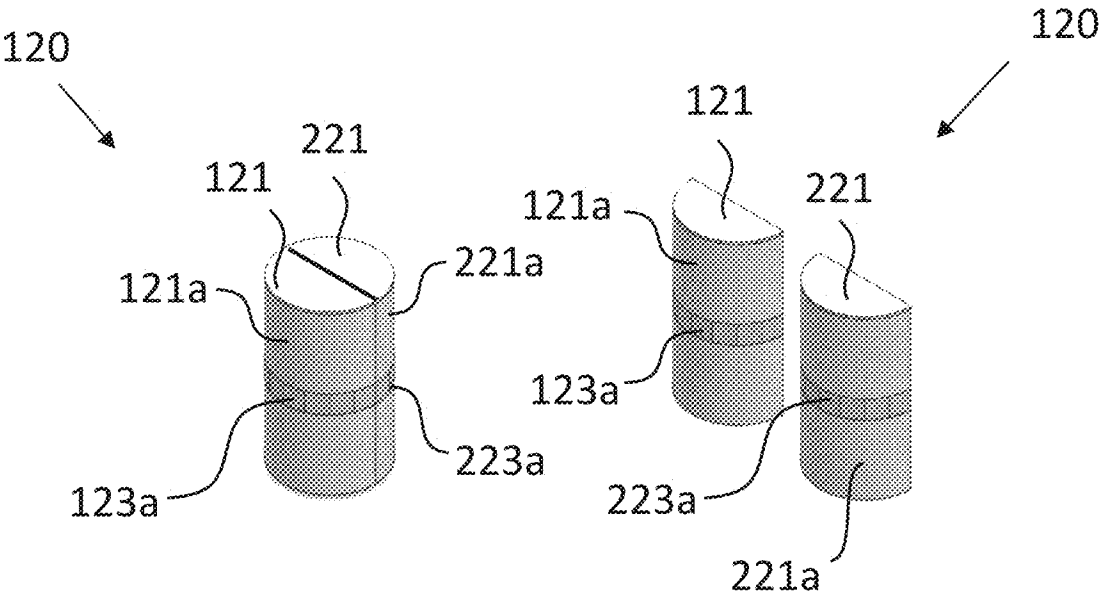
FIG. 2 shows a perspective view of a sound emission apparatus according to an embodiment in a first configuration and in a second configuration.

FIG. 2 shows a perspective view of the sound emission apparatus 120 according to an embodiment in a first configuration and in a second configuration. In comparison to the sound emission apparatus 120 shown in FIG. 1, the sound emission apparatus 120 shown in FIG. 2 comprises in addition to the loudspeaker enclosure 121 a further loudspeaker enclosure 221 comprising a further transducer array 223*a*.

In an embodiment, the further loudspeaker enclosure 221 that generally can have a half axisymmetric shape comprises a sound emission section 221*a* and a rear section 221*b*. In an embodiment the sound emission section 221*a* is coupled to or integral with the rear section 221*b* and generally defines a further surface of the half revolution about a further axis extending along a length of the further loudspeaker enclosure 221. In an embodiment, the further transducer array 223*a* is mounted on the sound emission section 221*a* of the further loudspeaker enclosure 221, wherein a further plane passing through the further transducer array 223*a* is orthogonal to the further axis. In an embodiment, the further transducer array 223*a* is curved such that the further transducer array 223*a* conforms to the curvature of the further surface of the half revolution. In an alternative embodiment, the further transducer array can be mounted within the further loudspeaker enclosure 221 and connected to a further array of waveguides defining a further array of sound emission ports in the sound emission section 221*a* of the further loudspeaker enclosure 221, wherein a further plane passing through the further array of sound emission ports is orthogonal to the further axis and the further array of sound emission ports being curved such that the further array of sound emission ports conforms to the curvature of the further surface of the half revolution.

In an embodiment, the rear section 221*b* of the further loudspeaker enclosure 221 is configured to be coupled to the rear section 121*b* of the loudspeaker enclosure 121 thereby generally defining an axis-symmetric shape. This is shown on the left hand side of FIG. 2, wherein the rear section 221*b* of the further loudspeaker enclosure 221 is coupled to the rear section 121*b* of the loudspeaker enclosure 121, thereby defining a first configuration of the sound emission apparatus 120. On the right hand side of FIG. 2, the loudspeaker enclosure 121 containing the transducer array 123*a* and the further loudspeaker enclosure 221 containing the further transducer array 223*a* are separated from each other, thereby defining a second configuration of the sound emission apparatus 120.

As illustrated in FIG. 2, in an embodiment the transducer array 123*a* substantially spans the width of the sound emission section 121*a* of the loudspeaker enclosure 121 and the further transducer array 223*a* substantially spans the width of the sound emission section 221*a* of the further loudspeaker enclosure 221.

As can be taken from FIG. 2, the loudspeaker enclosure 121 and the further loudspeaker enclosure 221 have the shape of a half cylinder. Generally, the loudspeaker enclosure 121 and the further loudspeaker enclosure 221 can define one half of an axis-symmetric shape, i.e. one half of a surface or solid of revolution, for instance, one half of a cone.

In an embodiment, the first transducer array 123*a* can be arranged on the sound emission section 121*a* of the loudspeaker enclosure 121 at the same height as the further transducer array 223*a* on the sound emission section 221*a* of the further loudspeaker enclosure 221. In an embodiment, the angular spacing $\Delta\phi$ between neighboring transducers of the transducer array 123*a* and the further transducer array 223*a* can be uniform. This means that if the transducer array 123*a* and the further transducer array 223*a* comprise in an embodiment 2L transducers, wherein the angular spacing $\Delta\phi$ between neighboring transducers is given by the following equation:

$$\Delta\phi = \frac{2\pi}{2L}\ \text{rad} \tag{2}$$

For the first configuration of the sound emission apparatus 120 shown on the left hand side of FIG. 2, where the rear section 121*b* of the loudspeaker enclosure 121 is coupled to the rear section of the further loudspeaker enclosure 221, the angular coordinate $\phi_l$ that identifies the position of the l-th transducer is given by:

$$\phi l = l\Delta\phi, l = 0, 1, \ldots, 2L-1 \tag{3}$$

For the second configuration of the sound emission apparatus 120 shown on the right hand side of FIG. 2, the angular coordinate of the l-th transducer for a given transducer array is given by:

$$\phi_l = \left(l + \frac{1}{2}\right)\Delta\phi,\ l = 0, 1, \ldots, L-1 \tag{4}$$

Figure 3:
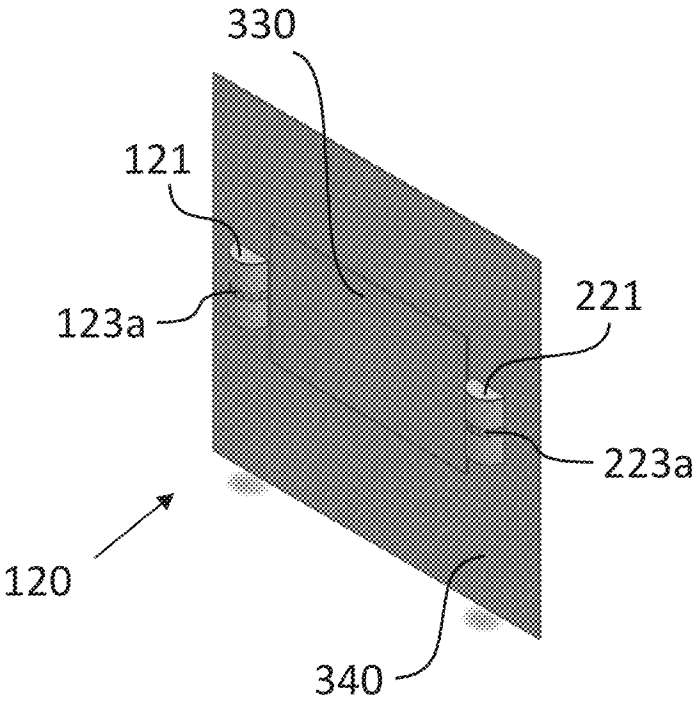
FIG. 3 shows a perspective view of a sound emission apparatus according to an embodiment in a second configuration.

FIG. 3 shows a perspective view of the sound emission apparatus 120 according to an embodiment in a second configuration, i.e. in a configuration, where the loudspeaker enclosure 121 including the transducer array 123*a* and the loudspeaker enclosure 221 including the transducer array 223*a* are physically separated from another. In the exemplary embodiment shown in FIG. 3, the loudspeaker enclosure 121 including the transducer array 123*a* and the loudspeaker enclosure 221 including the transducer array 223*a* are mounted on a wall 340 with their respective rear sections. In an embodiment, the sound emission apparatus 120 can be used together with a display 330, which in the exemplary embodiment shown in FIG. 3 is arranged between the loudspeaker enclosure 121 including the transducer array 123*a* and the loudspeaker enclosure 221 including the transducer array 223*a*.

Figure 4:
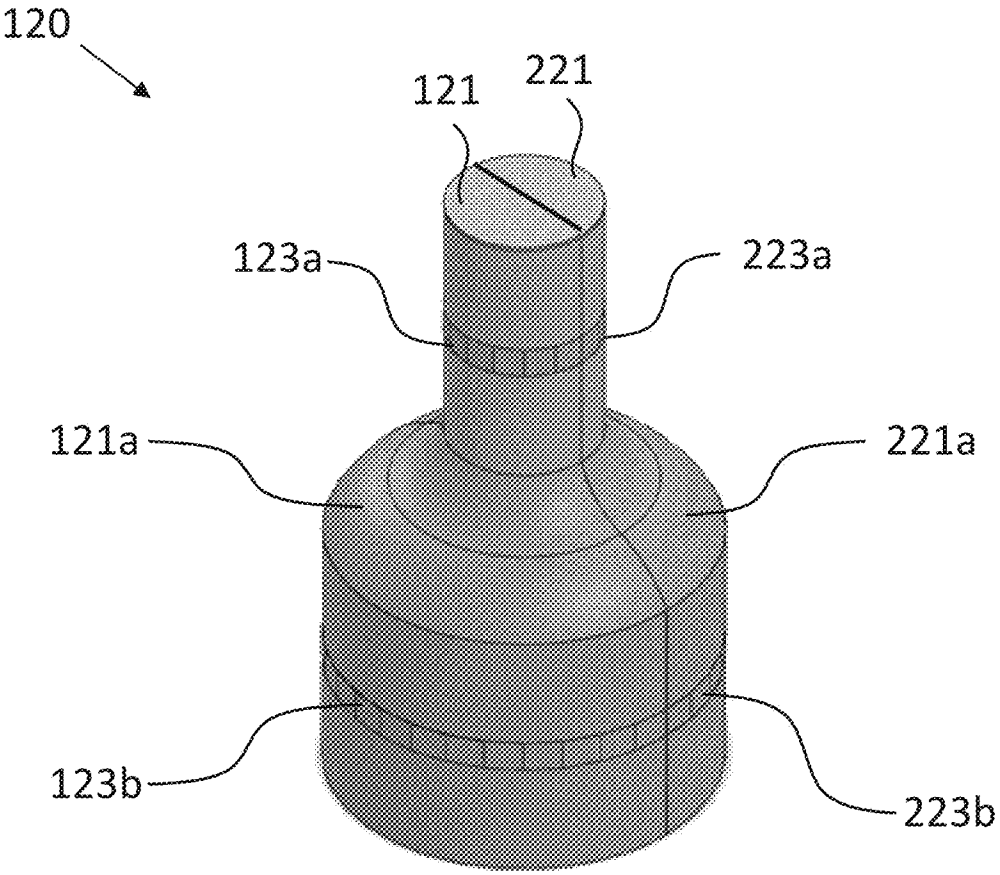
FIG. 4 shows a perspective view of a sound emission apparatus according to an embodiment in a first configuration.

FIG. 4 shows a perspective view of the sound emission apparatus 120 according to an embodiment in a first configuration, i.e. in a configuration, where the loudspeaker enclosure 121 including the transducer array 123*a* and the loudspeaker enclosure 221 including the transducer array 223*a* are coupled together by means of their respective rear sections. The sound emission apparatus 120 shown in FIG. 4 differs from the sound emission apparatus 120 shown in FIGS. 2 and 3 primarily in two aspects. Firstly, the loudspeaker enclosure 121 and the loudspeaker enclosure 221 of the sound emission apparatus 120 shown in FIG. 4 together do not define the shape of a cylinder, as in the case of the embodiment shown in FIG. 2, but an axis-symmetric bottle-like shape. Secondly, the loudspeaker enclosure 121 and the loudspeaker enclosure 221 of the sound emission apparatus 120 shown in FIG. 4 each contain two transducer arrays at different heights, namely the transducer arrays 123*a* and 123*b* as well as the transducer arrays 223*a* and 223*b*. In an embodiment, a first plane passing through the first transducer array 123*a*, 223*a* is orthogonal to the symmetry axis of the sound emission apparatus 120 and a second plane passing through the second transducer array 123*b*, 223*b* is also orthogonal to the symmetry axis, such that the first and second planes are parallel to each other.

In an embodiment, the transducer arrays 123*a*, 223*a* and the transducer arrays 123*b*, 223*b* can be used either independently to generate different sound beams or can be used in combination to generate the same beam (or beams). It is possible, for example, to use the different transducer arrays (with different transducer characteristic or arrangement) to reproduce different frequency portions of the spectral content of the sound beam (or beams) to be generated.

An ideal configuration would include an infinite number of circular transducer arrays, such that each combination of transducer arrays of radius $r(\omega)$ is used for a single frequency $\omega$. The radius is chosen such that the product $\omega \cdot r(\omega)$ is kept constant. It can be shown that in this ideal case the impulse response of the filters $R_n$ is constant. However, such an ideal configuration is clearly not practical and in practice generally a finite number of transducer arrays should be chosen. For instance, in the embodiment shown in FIG. 4 the first transducer arrays 123*a* and 223*a* define a first circle having a radius $r_1$ and the second transducer arrays 123*b* and 223*b* define a second circle having a larger radius $r_2$. In an embodiment, the sound emission apparatus 120 is configured to provide a first band-limited audio signal with a first frequency range approximately in the vicinity of an angular frequency $\omega_1$, and provide a second band-limited audio signal with a second frequency range approximately in the vicinity of an angular frequency $\omega_2$, wherein the angular frequencies $\omega_1$ and $\omega_2$ are given by the following equation or an equation derived therefrom:

$$\omega_a = \frac{\pi c}{r_a \Delta\phi_a}, \tag{5}$$

wherein the index a can take on the values 1 or 2, c denotes the speed of sound and $\Delta\phi_a$ denotes the angular separation of the transducers of the first and second transducer arrays.

Thus, by means of the present disclosure it is possible to design different transducer arrays optimized for different frequency ranges. In this case, the input signal to a given beam can be separated into a number of frequency bands (using for example a multi-band crossover network), each of which corresponds to the input signal to a given combination of transducer arrays. Thus, in an embodiment of the audio signal processing apparatus 100, the audio signal processing apparatus 100 further comprises a filter network for dividing the input audio signal 101 into two or more divided input audio signals of differing frequency bandwidths, thereby providing at least a first and second input audio signal, and a further filter unit, a further plurality of scaling units, and a further plurality of adders for processing the second input audio signal, thereby providing a second output audio signal for producing the sound field having the beam directivity pattern defined by the plurality of gain coefficients.

Figure 5:
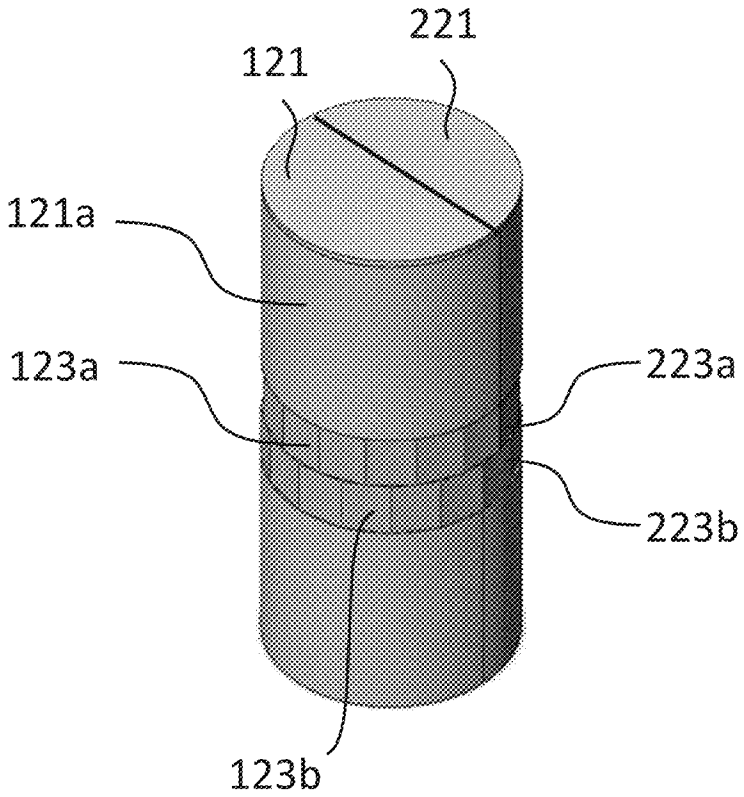
FIG. 5 shows a perspective view of a sound emission apparatus according to an embodiment in a first configuration.

FIG. 5 shows a perspective view of the sound emission apparatus 120 according to an embodiment in a first configuration, i.e. in a configuration, where the loudspeaker enclosure 121 including the transducer array 123*a* and the loudspeaker enclosure 221 including the transducer array 223*a* are coupled together by means of their respective rear sections. The sound emission apparatus 120 shown in FIG. 5 differs from the sound emission apparatus 120 shown in the previous figures primarily in that the first transducer arrays 123*a* and 223*a* have an angular offset relative to the second transducer arrays 123*b* and 223*b*, which in the embodiment shown in FIG. 5 are arranged immediately below the first transducer arrays 123*a* and 223*a*. In other words, the positions of the transducers of the first transducer arrays 123*a* and 223*a* can have an angular offset relative to the positions of the transducers of the second transducer arrays 123*b* and 223*b*. In an embodiment of the sound emission apparatus 120, the angular offset can be about half of the angular spacing between neighboring transducers of the first transducer arrays 123*a* and 223*a*. This approach allows increasing the operational frequency range of the sound emission apparatus 120 by increasing the frequency limit above which the beam directional pattern is corrupted by spatial aliasing.

Figure 6:
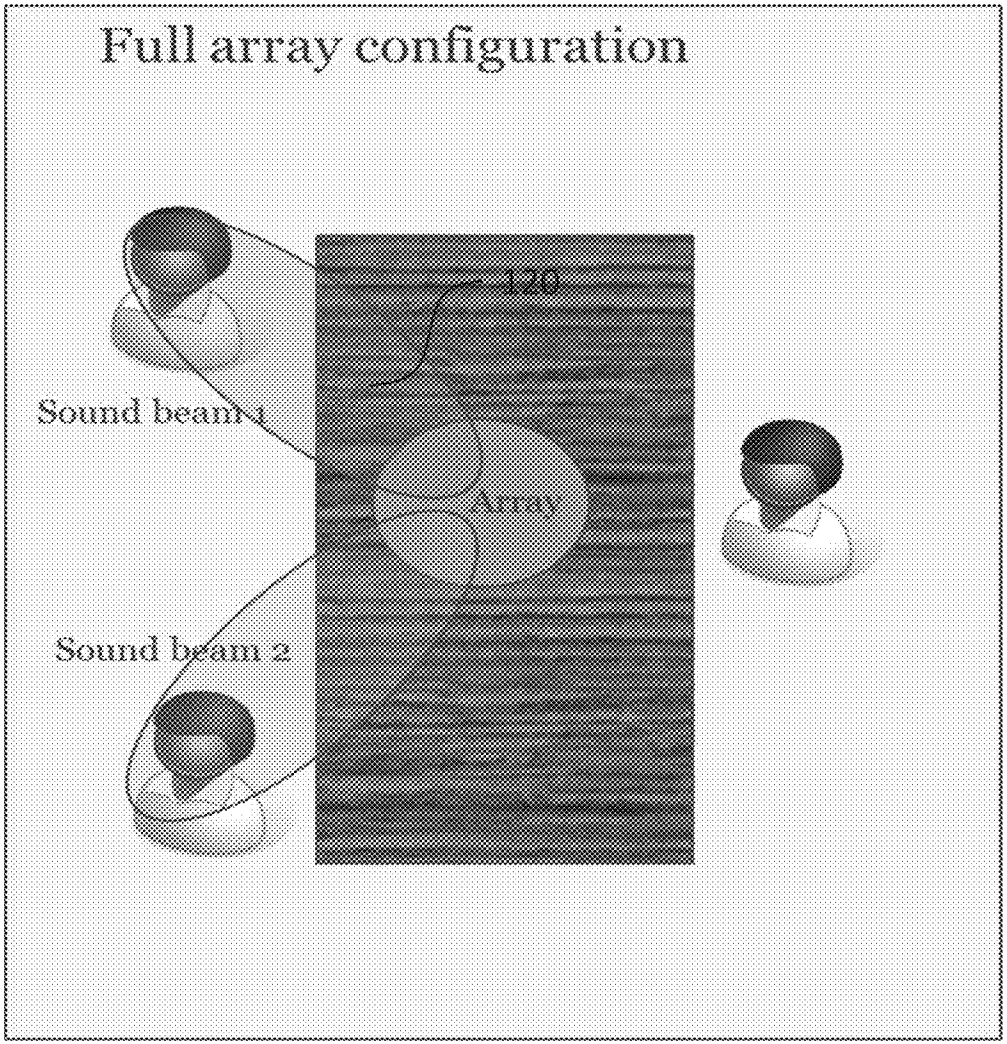
FIG. 6 shows a schematic top view of an implementation scenario for a sound emission apparatus according to an embodiment in a first configuration.
Figure 7:
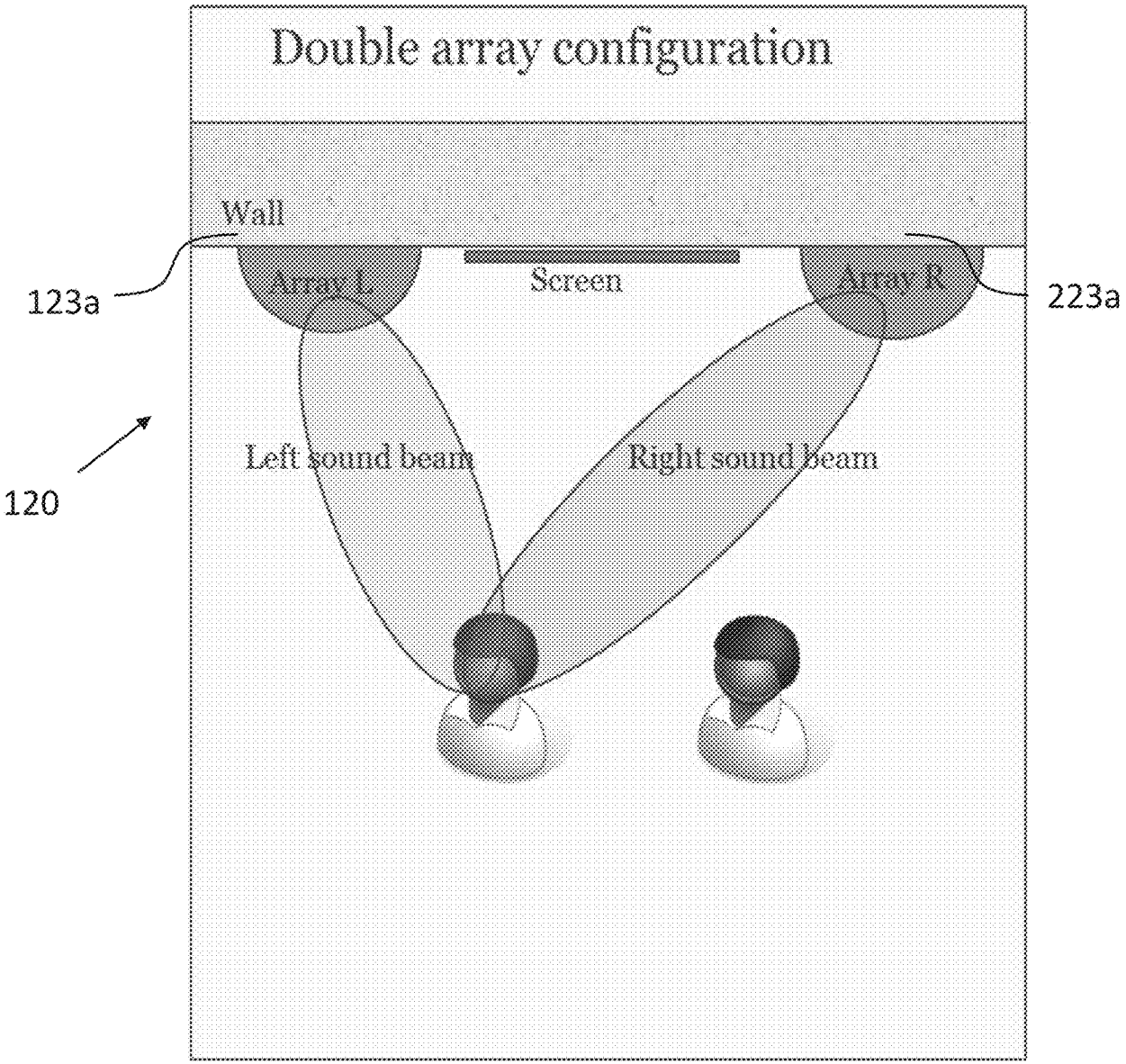
FIG. 7 shows a schematic top view of an implementation scenario for a sound emission apparatus according to an embodiment in a second configuration.
Figure 8:
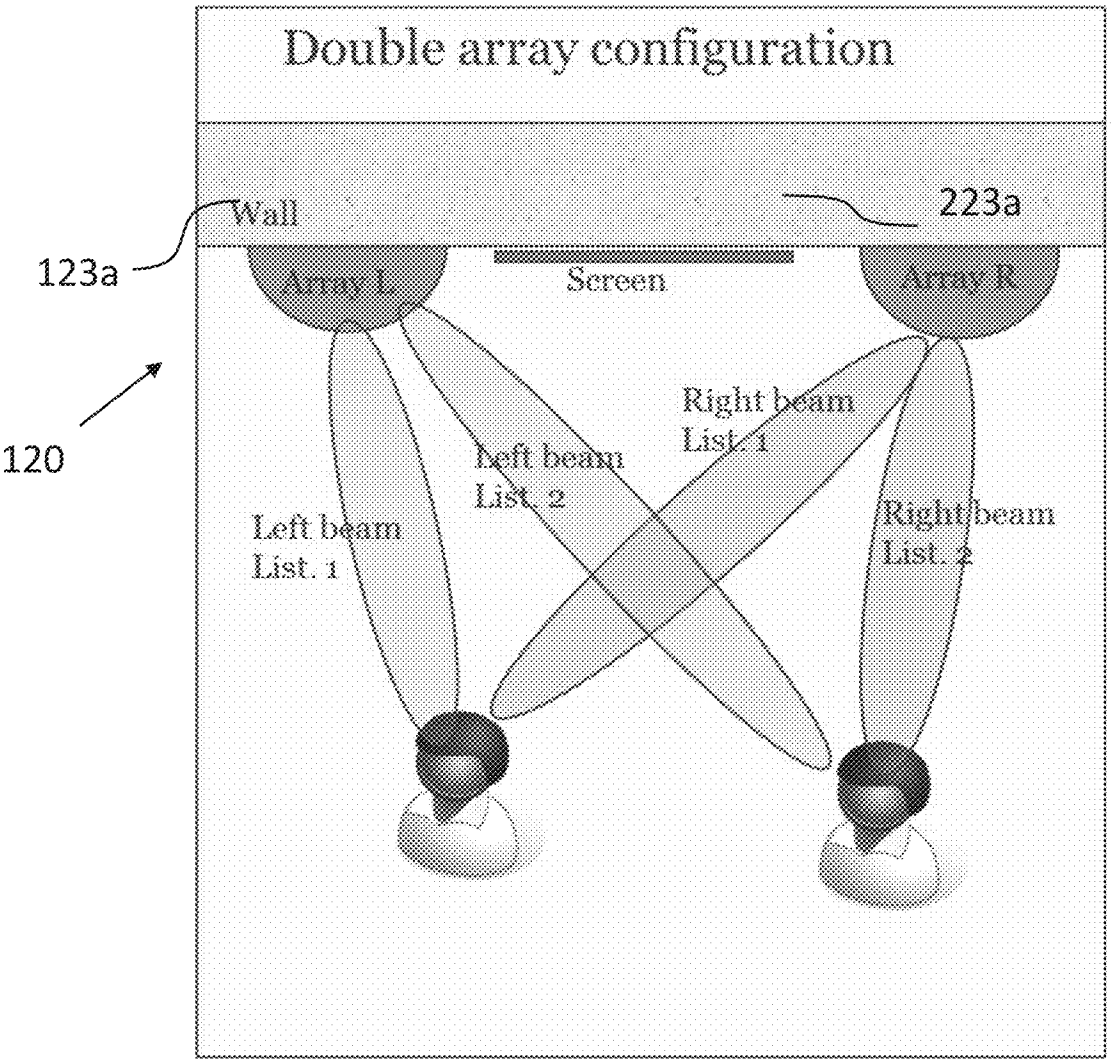
FIG. 8 shows a schematic top view of an implementation scenario for a sound emission apparatus according to an embodiment in a second configuration.

In an embodiment, the audio signal processing apparatus 100 and the below described further embodiments thereof implement a signal processing strategy to produce the input signals for the transducers of the transducer array(s) 123*a,b*, 223*a,b* of the sound emission apparatus 120 for generating one or more directed sound beams. FIGS. 6 to 8 show exemplary implementation scenarios of the sound emission apparatus 120, which can be achieved by different signal processing strategies implemented in the audio signal processing apparatus 100, as will be described in more detail further below.

FIG. 6 shows an embodiment of the sound emission apparatus 120 in the first configuration, wherein the audio signal processing apparatus 100 is configured such that the sound emission apparatus 120 emits a first sound beam in a first direction defined by a first listener and a second sound beam in a second direction defined by a second listener.

FIG. 7 shows an embodiment of the sound emission apparatus 120 in the second configuration, wherein the audio signal processing apparatus 100 is configured such that one transducer array of the sound emission apparatus 120 emits a left channel sound beam in a first direction and the other transducer array of the sound emission apparatus 120 emits a right channel sound beam in a second direction, wherein the first and the second direction are defined by the position of a listener.

FIG. 8 shows an embodiment of the sound emission apparatus 120 in the second configuration, wherein the audio signal processing apparatus 100 is configured such that one transducer array of the sound emission apparatus 120 emits a first left channel sound beam in a first direction and a second left channel sound beam in a second direction and the other transducer array of the sound emission apparatus 120 emits a first right channel sound beam in a first direction and a second right channel sound beam in a second direction. This could be used, for example, to provide multisport stereo.

In the following reference will be made primarily to the transducer array 123*a* with the understanding that embodiments of the audio signal processing apparatus 100 can be configured to produce the input signals for the transducers of the transducer arrays 123*a,b*, 223*a,b* of the embodiments of the sound emission apparatus 120 described above.

Typically, a sound beam is characterized by a given directivity pattern f(r, $\phi$, $\omega$), which defines the acoustic sound pressure generated by the transducer array 123*a* of the sound emission apparatus 120 on a circumference of a circle with a given radius r, whose center can coincide with the center of the transducer array 123*a* and which can lie on the equatorial plane. The radiation pattern is a function of the angle $\phi$ (which identifies a given point on the circumference) and of the frequency (o of the sound to be reproduced. Also each transducer of the transducer array 123*a*, wherein the l-th transducer is located at an angular position $\phi_l$, is associated with a given directivity pattern $G_{NF}(r, \phi_l, \phi, \omega)$, defined in the same manner as the directivity pattern of a sound beam.

Each sound beam is associated with a given single-channel audio signal x(t), hereafter referred to as "input signal" of the given beam. Each beam is associated with a "steering angle" (or beam direction) $\phi_0$, which identifies the angular coordinate corresponding to the maximum of the absolute value of the radiation pattern associated with that beam.

Figure 9:
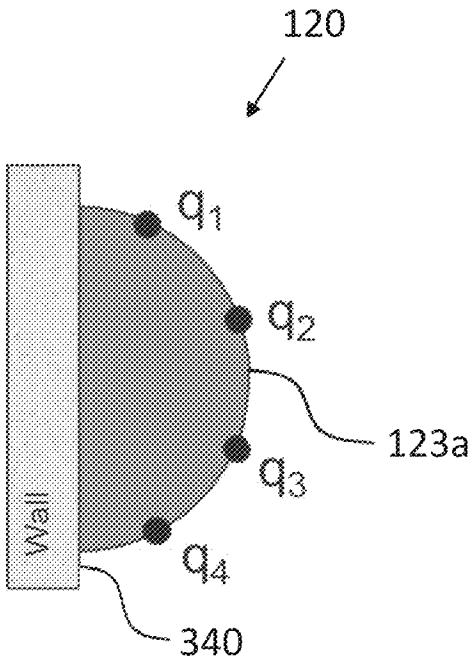
FIG. 9 shows a schematic top view of a sound emission apparatus according to an embodiment in a first configuration and in a second configuration.
Figure 9:
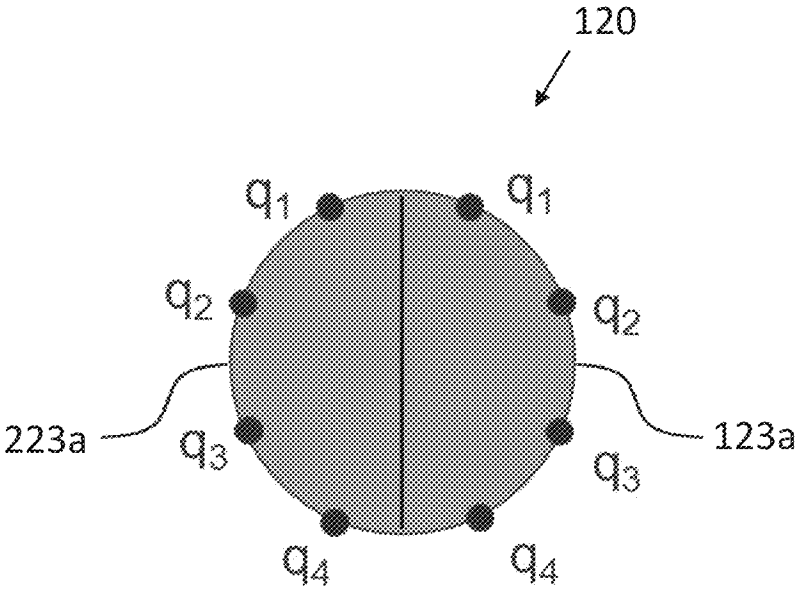

For the following mathematical derivation it is assumed that the loudspeaker enclosure 121 and the transducer array 123*a* are arranged on a flat (and ideally infinite) acoustically reflecting wall 340, as shown on the right hand side of FIG. 9. The directivity pattern of the l-th transducer located at $\phi_l$ can be expressed using the following equation:

$$G_{NF}(r,\phi_l,\phi,\omega)=\Sigma_{n=0}^{\infty}(2-\delta_n)\cos(n\phi_l)\cos(n\phi)\Gamma_n(r,\omega), \tag{6}$$

wherein $\delta_n$ denotes the Kronecker delta being equal to 1 if n=0 and equal to 0 otherwise and the coefficients $\Gamma_n(r, \omega)$ depend primarily on the geometry of the transducer array 123*a*. An analytical expression for the coefficients $\Gamma_n(r, \omega)$ is derived in the mathematical appendix further below for the case of the transducers of the transducer array 123*a* being flush-mounted on the surface of the sound emission section 121*a*, which is configured as a rigid hemi-cylinder.

The directivity pattern of a sound beam (also referred to as beam directivity pattern) can be expressed using the following equation:

$$f(\phi)=\Sigma_{n=0}^{N}\sqrt{2-\delta_n}\cos(n\phi)f_n. \tag{7}$$

Typically, the directivity coefficients $f_n$ depend on the steering direction and characteristics of the beam. In an embodiment, the directivity coefficients $f_n$ can be independent of the frequency ω. In an embodiment, the directivity coefficients $f_n$ can be chosen to be frequency dependent.

In an embodiment of the audio signal processing apparatus 100, the beam directivity pattern is a single beam in a direction defined by an angle $\phi_0$ (also referred to as steering angle), wherein the n-th directivity coefficient $f_n$ is defined by the following equation or an equation derived therefrom:

$$f_n=\sqrt{2-\delta_n}\gamma(\phi_0)\cos(n\phi_0), \tag{8}$$

wherein $\gamma(\phi_0)$ is an angular dependent factor given by the following equation or an equation derived therefrom:

$$\gamma(\phi_0) = \frac{1}{\sum_{n=0}^{N}(2-\delta_n)\cos(n\phi_0)^2}. \tag{9}$$

The angular dependent factor $\gamma(\phi_0)$ advantageously ensures that the pressure level in the steering direction does not vary as a function of the steering angle $\phi_0$. The parameter N controls the width of the beam (the larger N the higher is the beam directivity). Other choices than equation (8) for the directivity coefficient $f_n$ are possible.

Above equations (7) and (8) are the Fourier series representation of symmetric directivity patterns. Indeed, the sound radiated by the sound emission apparatus 120 mounted on a rigid wall can be interpreted as the sound radiated by a full axisymmetric array, wherein each pair of transducers located at $\phi_l$ and at $-\phi_l$, respectively, are driven with the same input signals (hence the symmetry of the directivity pattern with respect to the rigid wall).

Note that the angular coordinate ϕ in all equations above varies from 0 to π radians, because the directivity pattern is defined over a hemi-circumference (as opposed to a circumference for the first configuration of the sound emission apparatus). Also the transducers of the transducer array 123*a* are arranged on a hemi-circumference. This implies that conventional beamforming methods for circular arrays cannot be applied in this case.

The mathematical derivation of the new approach proposed by the present disclosure is described in detail in the mathematical appendix further below and can be regarded as a reformulation of the mode-matching approach specifically derived for a hemi-circular arrangement of transducers. As will become clear from the below, the derivation no longer involves the Fourier series, as in above equation (1), but the Discrete Cosine Transform, as defined in equation (A.23).

It should be also emphasized that, as opposed to the case of a circular array, the sound beam directivity pattern is not rotationally invariant. This means that the shape of the directivity pattern depends on the steering angle $\phi_0$. This is caused by the presence of the reflective wall 340. For this reason, it is advantageous to include the factor $\gamma(\phi_0)$, in order to ensure that the value of the directivity pattern at $\phi_0$ is unitary.

The signal processing scheme is based on a pre-knowledge of the Green function $G_{NF}(r, \phi_l, \phi, \omega)$ (already referred to above as directivity pattern). In an embodiment, the Green function $G_{NF}(r, \phi_l, \phi, \omega)$ can be computed by means of numerical methods or measurements. An analytical expression of the Green function $G_{NF}(r, \phi_l, \phi, \omega)$ for the embodiment, where the transducers of the transducer array 123*a* are flush-mounted on the surface of the sound emission section 121*a*, which for the analytical derivation is assumed to have the shape of the surface of an infinite and rigid hemi-cylinder, and where the apparatus 120 itself is mounted on an infinite rigid wall is disclosed in the mathematical appendix further below.

Figure 10:
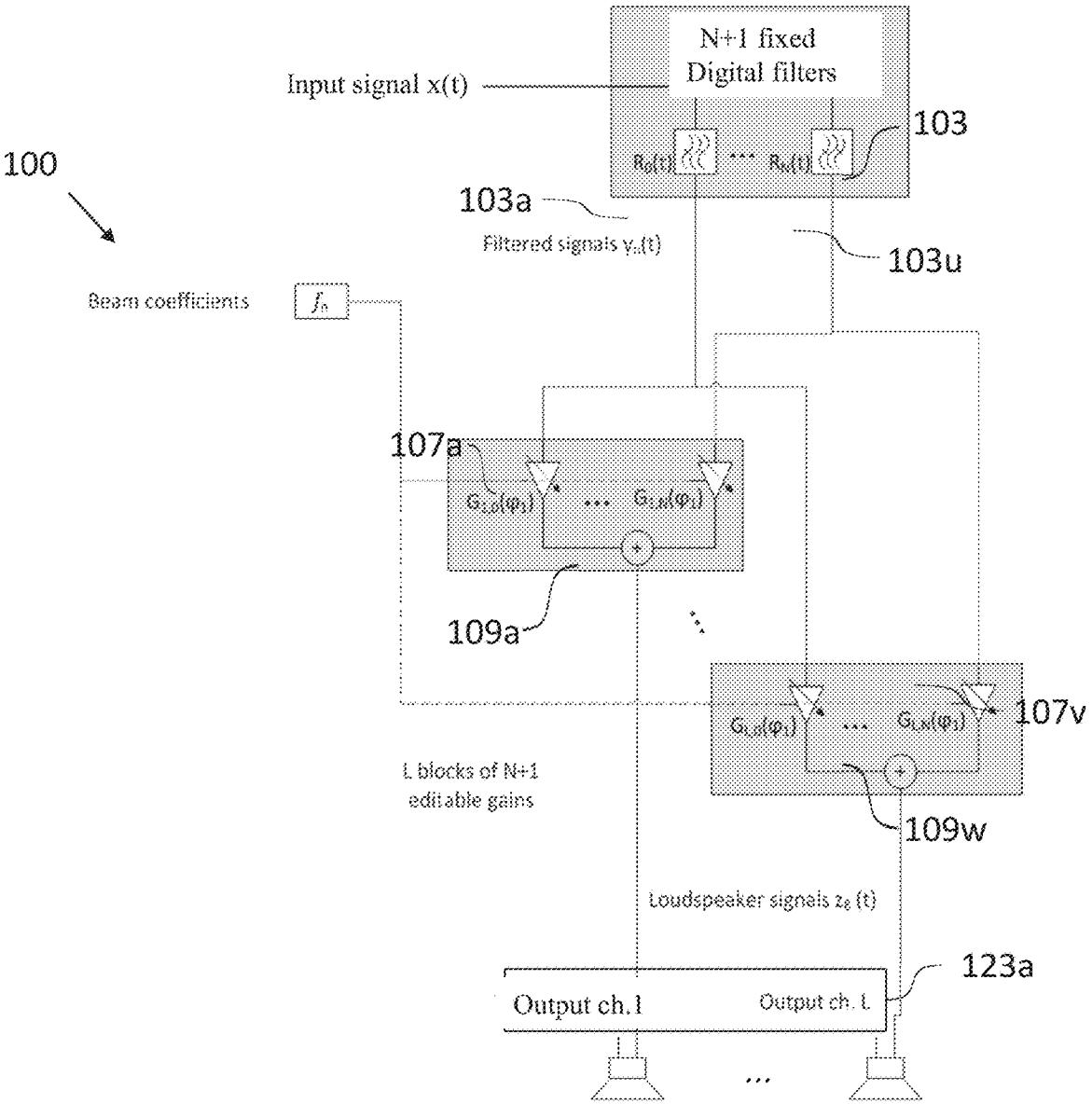
FIG. 10 shows a schematic diagram illustrating an audio signal processing apparatus according to an embodiment.

A schematic diagram of a signal processing scheme implemented in an embodiment of the audio signal processing apparatus 100 for generating a single beam with a single transducer array is shown in FIG. 10. In an embodiment, the sound beam has the directivity pattern given by equation (8). The signal x(t) is input to a filter unit or filter bank 103 of N filters. For the sake of clarity only two of those N filters have been identified by reference signs in FIG. 10, namely the filter 103*a* and the filter 103*u*.

In an embodiment of the audio signal processing apparatus 100, the impulse response of the n-th filter of the filters of the filter unit 103 is defined by the following equation or an equation derived therefrom:

$$R_n(t) = F^{-1}\left[\frac{1}{\Gamma_n(r, \omega)}\right], \tag{10}$$

wherein $F^{-1}$ denotes the inverse Fourier transformation, $\Gamma_n$ characterizes, as a function of radial distance r and frequency ω, an n-th order coefficient of a Fourier series describing a radiation polar pattern of the transducer array 123*a* conforming to the curvature of a surface of a full revolution comprising the surface of the half revolution, the n-th order coefficient is dependent on the shape of the sound emission region 121*a* of the loudspeaker enclosure 121, and $R_n(t)$ denotes the impulse response of the n-th filter of the filter unit 103 as a function of time. As the person skilled in the art will appreciate, equation (10) is a simplified version of the following equation:

$$R_n(t) = F^{-1}\left[\frac{\Gamma_n(r, \omega)^*}{|\Gamma_n(r, \omega)|^2}\right], \tag{11}$$

wherein * denotes the complex conjugate.

In a further embodiment, the impulse response of the n-th filter of the filters of the filter unit 103 can comprise a definable regularization parameter $\beta_n$ (which is generally frequency dependent). Thus, in an embodiment of the audio signal processing apparatus 100, the impulse response of the n-th filter of the filter unit 103 is defined by the following equation or an equation derived therefrom:

$$R_n(t) = F^{-1}\left[\frac{\Gamma_n(r, \omega)^*}{|\Gamma_n(r, \omega)|^2 + \beta_n(\omega)}\right]. \tag{12}$$

As will be described in more detail in the mathematical appendix further below, in an embodiment of the audio signal processing apparatus 100, $\Gamma_n$ is defined by the following equation or an equation derived therefrom:

$$\Gamma_n=2i^{-n}b_n(kR), \tag{13}$$

wherein the function $b_n(kR)$ is defined by the following equation or an equation derived therefrom:

$$b_n(\xi) = \frac{2i}{\pi\xi H_n'(\xi)}, \tag{14}$$

wherein ξ denotes the product kR, k denotes the wave number, R denotes the radius of the surface of a half revolution and $H_n'$ denotes the derivative of the n-th order Hankel function.

The filtered audio signals $y_n(t)$ are defined as the output of the filter with impulse response $R_n(t)$. The signals $y_n(t)$, n=0, 1 . . . , N are input to L banks of gains or scaling units (one bank of gains for each source of the sub-array). For the sake of clarity only two scaling units or gains have been identified by reference signs in FIG. 10, namely the scaling units 107*a* and the scaling unit 107*v*. Each bank of scaling units includes N scaling units, each of which applies a gain coefficient to the corresponding signal filtered audio signal $y_n(t)$.

In an embodiment, the n-th gain coefficient, i.e. the gain coefficient provided by the n-th scaling unit, for the l-th transducer of the transducer array 123*a* is defined by the following equation or an equation derived therefrom:

$$G_{n,l} = \frac{\sqrt{2-\delta_n}}{L}\cos(n\phi_l)f_n, \tag{15}$$

wherein $\delta_n$ denotes the Kronecker delta being equal to 1 if n=0 and equal to 0 otherwise, L denotes the number transducers of the transducer array 123*a*, and $f_n$ characterizes the n-th coefficient of the Fourier series or Fourier cosine series describing a desired beam directivity pattern as a function of the radiation angle. As the person skilled in the art will appreciate, the gain coefficient depends on the parameters of the desired beam directivity pattern, on the index n, and on the angular coordinate of the given transducer. The output signals of a single bank of scaling units are summed by an adder, for instance, the adders 109*a* and 109*w* identified in FIG. 10, thus generating the output audio signal $z_l(t)$ that is the input to the l-th transducer of the transducer array 123*a*.

Thus, in an embodiment of the audio signal processing apparatus 100, the output audio signal $z_l(t)$ for the l-th transducer of the transducer array 123*a* is defined by the following equation or an equation derived therefrom:

$$z_l(t)=\Sigma_{n=0}^{L-1}[x(t)\otimes R_n(t)]G_{n,l}, \tag{16}$$

wherein $z_l(t)$ denotes the output signal as a function of time, x(t) denotes the input audio signal as a function of time, ® denotes the convolution operator, where n can range from 0 to N and N depends on the beam directivity pattern, and $G_{n,l}(\phi_0)$ denotes the n-th gain coefficient for the l-th transducer of the transducer array 123*a*.

Figure 11:
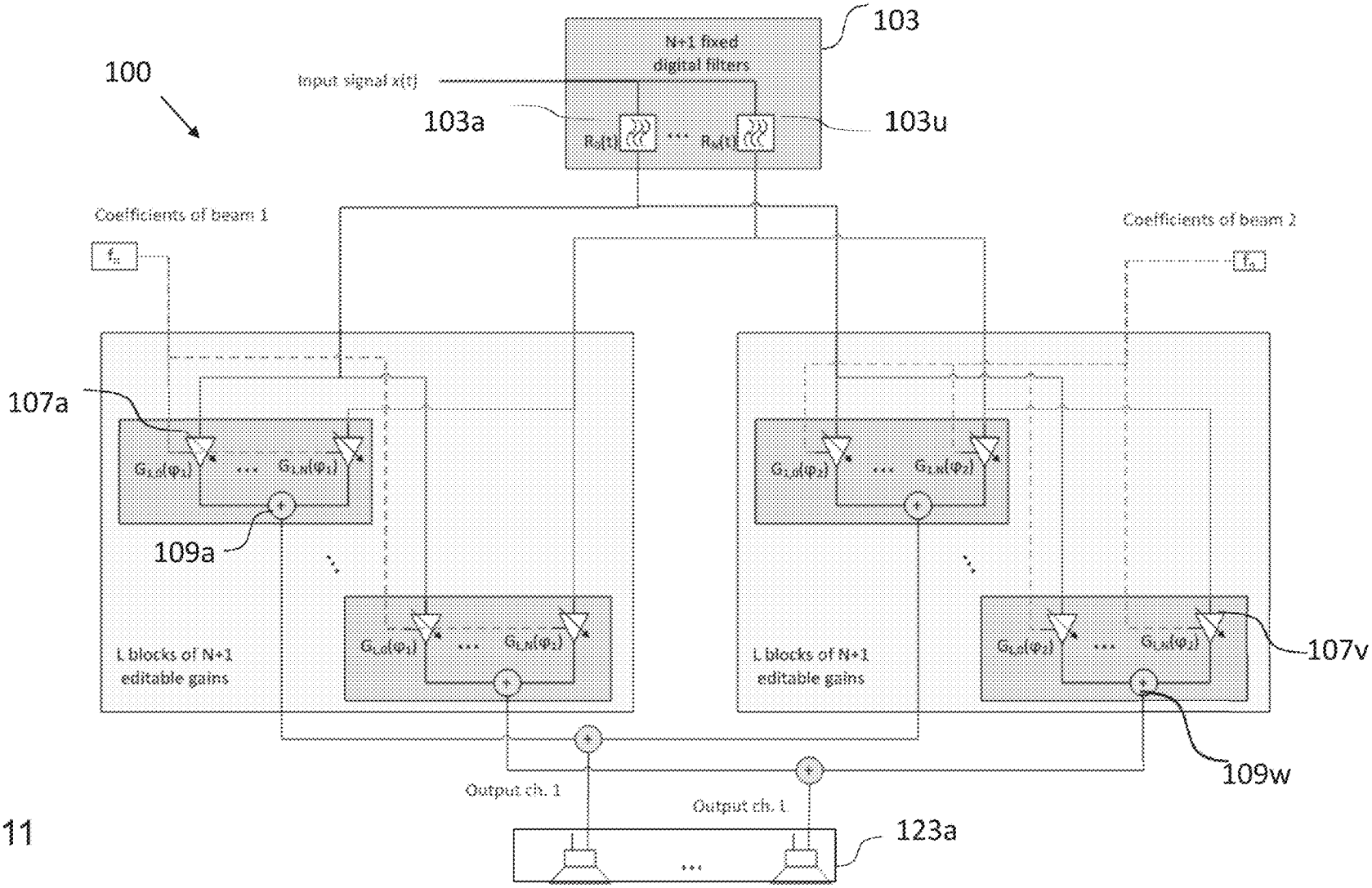
FIG. 11 shows a schematic diagram illustrating an audio signal processing apparatus according to an embodiment.

In an embodiment, the sound emission apparatus 120 including the audio signal processing apparatus 100 can also generate multiple sound beams using only a single transducer array, for instance, the transducer array 123*a*. To this end, in an embodiment the linear superposition principle can be applied. A number of input signals equal to the number of beams should be provided. Each of these signals is processed using the signal processing strategy described in the context of FIG. 10 and the signals $z_l(t)$ are summed before being fed to the transducers. In an embodiment, it is possible to generate multiple beams that are associated with the same input signal x(t), but are steered to different directions (or, more generally, have different characteristics). In this case only one filter unit 103 comprising a plurality of filters with in impulse response $R_n(t)$, such as the filter 103*a* and the filter 103*u*, is sufficient, as shown in FIG. 11.

Thus, in an embodiment of the audio signal processing apparatus 100, the beam directivity pattern is defined by multiple beams in respective directions defined by a respective angle $\phi_j$ and the output audio signal $z_l(t)$ for the l-th transducer of the transducer array 123*a* is given by the following equation or an equation derived therefrom:

$$z_l(t)=\Sigma_{n=0}^{L-1}\Sigma_{j=1}^{J}[x(t)\otimes R_n(t)\otimes\delta(t-\tau_j)K_j]G_{n,l}(\phi_j), \tag{17}$$

wherein J denotes the total number of beams of the beam directivity pattern, $\tau_j$ denotes the time delay for the j-th beam and $K_j$ denotes the gain for the j-th beam.

Figure 12:
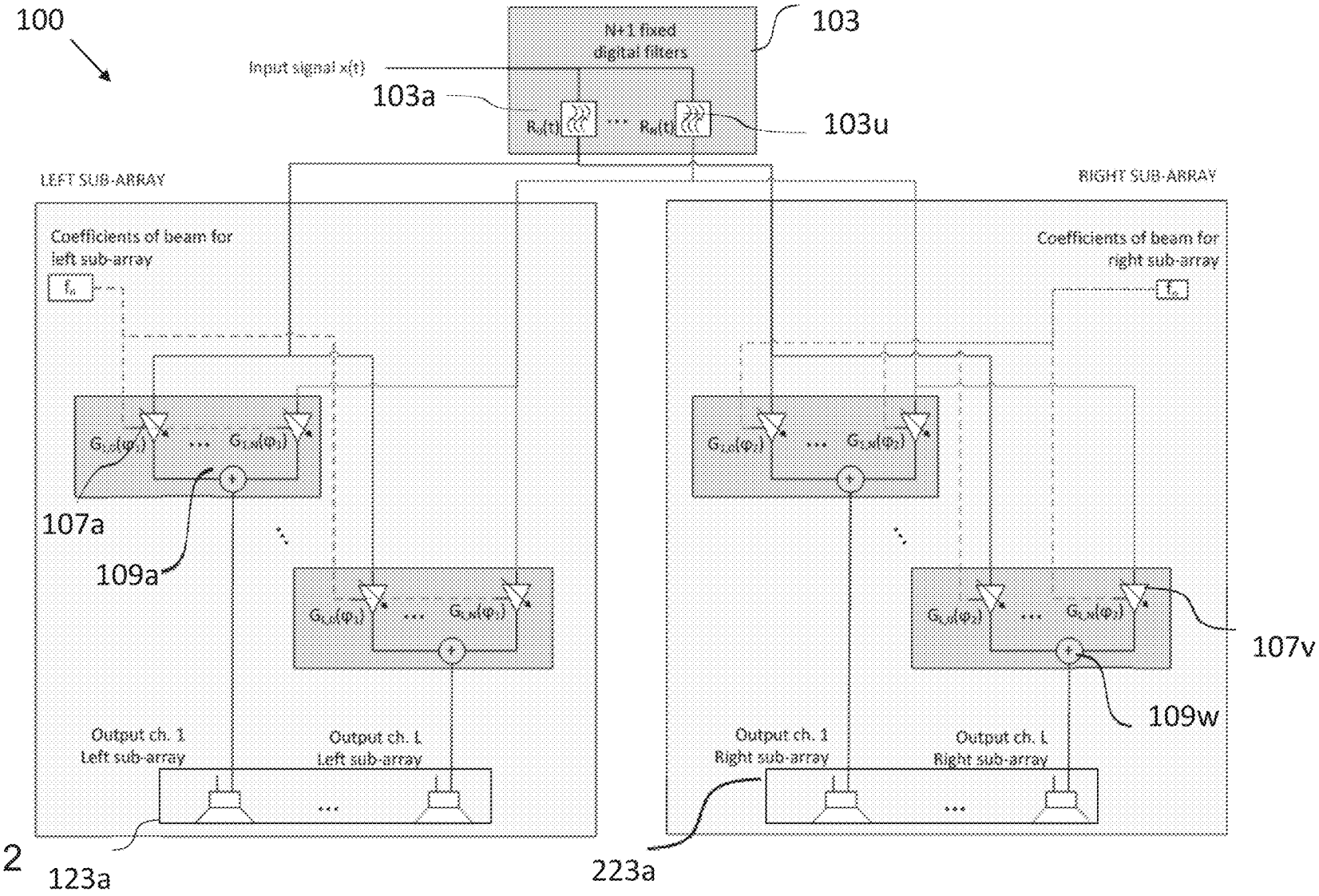
FIG. 12 shows a schematic diagram illustrating an audio signal processing apparatus according to an embodiment.

FIG. 12 shows an embodiment for the case when two transducer arrays are used, for instance, the transducer array 123*a* and the transducer array 223*a*. In an embodiment, each transducer array 123*a*, 223*a* can generate an arbitrary number of beams, each of which can be directed to a given target location, for example the region of space occupied by a listener, as illustrated in FIG. 8. As already described above, FIG. 7 represents the case of two beams directed towards a single listener and each beam is generated by one transducer array 123*a*, 223*a*. The input signals of the two beams can be, for example, the left and right channel of a stereo signal. If the two transducer arrays 123*a*, 223*a* shown in FIG. 12 generate beams by means of the same input signal, it is sufficient to have one filter unit 103 comprising a plurality of filters, such as the filters 103*a* and 103*u* identified in FIG. 12.

A use case for the embodiment shown in FIG. 12 is shown in FIG. 7, namely the case when the left transducer array 123*a* generates two (or more) beams associated with the left channels of two (or more) different stereo signals and steered towards two (or more) listeners and the right transducer array 223*a* does the same but for the right channels of the considered stereo signals. Another use case for the embodiment shown in FIG. 12, which is also shown in FIG. 8, is given by the same stereo or binaural signal being delivered to two listeners located at two different positions. In this case each transducer array 123*a*, 223*a* generates two beams associated with the same signal (left or right channel of a stereo signal) but steered towards different directions.

The directivity of a sound beam at low frequencies is generally limited by the physical size of the transducer array. For instance, the generation of a highly directive low-frequency bream with a small transducer array requires that the transducers a driven by signals with very large amplitude, which may degrade the performance of the sound emission apparatus 120 when this departs form ideal conditions. Thus, in an embodiment of the audio signal processing apparatus 100, the audio signal processing apparatus 100 further comprises a bass enhancement unit, wherein the bass enhancement unit is configured to process each audio input signal 101 individually upstream of the filter unit 103, the plurality of scaling units 107*a-v*, and the plurality of adders 109*a-w*. A psychoacoustical bass-enhancement unit in combination with the signal processing strategies described above allow a listener to perceive the low-frequency component of a given audio signal, without the sound emission apparatus 100 physically reproducing the lower part of the signal spectrum (or generating little energy in that frequency range). With this approach the transducer array can generate a band-limited (i.e. without low frequencies) but highly directive beam, but a listener in the sweet-spot of the sound beam will (ideally) perceive a full-range audio signal. In an embodiment, the processing by the bass enhancement unit is applied to each input signal individually.

In the following mathematical appendix, some of the equations used above will be derived and/or explained in more detail. Firstly, the analytical expression is derived for the radiation pattern of an ideal omnidirectional transducer or loudspeaker (ideal monopole) flush-mounted on the surface of an infinite rigid hemi-cylinder arranged on a rigid, infinite wall, as shown on the right hand side of FIG. 9. To that end, an equivalent scattering approach is used. More specifically, the far-field approximation in the direction $\phi_q$, $\theta_q$ of the field generated by a point source on the rigid hemi-cylinder at location $\phi$, z on the hemi-cylinder is identical to the sound field generated by a plane wave impinging from direction $\phi_q$, $\theta_q$ scattered by the hemi-cylinder and by the hard wall, and measured on the surface of the hemi-cylinder at position $\phi$, z.

It is assumed that the sound field of interest is defined in the hemispace with y>0 and is bounded by a rigid wall on the xz-plane. This imposes the following Neumann boundary condition on the field:

$$\frac{\partial p(x, y, z)}{\partial y} = 0,\ y = 0 \tag{A.1}$$

The field due to a plane wave impinging from an angle $\phi_q$, $\theta_q$ and reflected by a rigid wall located at $\phi=0$, $\pi$ (this corresponds to a wall on the plane y=0). This is given by the linear summation of two plane waves from $\phi_q$, $\theta_q$ and from $-\phi_q$, $\theta_q$, respectively, in the half-space defined by $0\le\phi\le\pi$. In polar coordinates and for z=0 this is given by:

$$\begin{aligned} p(r, \phi, 0) &= \sum_{n=-\infty}^{\infty} e^{in\phi} J_n(kr)[i^{-n}(e^{-in\phi_q} + e^{in\phi_q})] \\ &= \sum_{n=-\infty}^{\infty} e^{in\phi} J_n(kr) i^{-n} 2\cos(n\phi_q) \end{aligned} \tag{A.2}$$

where $J_n(\xi)$ is the Bessel function of order n and the Jacobi-Anger expansion has been used, as disclosed, for instance, in D. L. Colton and R. Kress, "Inverse Acoustic and Electromagnetic Scattering Theory", Applied Mathematical Sciences, Springer, Berlin, 1992. Considering the Bessel function relation $J_{-n}(\xi)=(-1)^n J_n(\xi)$ it follows that:

$$e^{in\phi} i^{-n} J_n(k,r) + e^{-in\phi} i^{n} J_{-n}(k,r) = 2\cos(n\phi) i^{-n} J_n(k,r) \tag{A.3}$$

This implies that the field is symmetric with respect to the plane defined by the wall. The Fourier series in equation (A.2) can therefore be substituted by the following cosine series:

$$\begin{aligned} p(r, \phi, 0) &= 2J_0(kr) + \sum_{n=1}^{\infty} \cos(n\phi) J_n(kr) i^{-n} 2\cos(n\phi_q) \\ &= \sum_{n=0}^{\infty} \epsilon_n^2 \cos(n\phi) J_n(kr) 2 i^{-n} \cos(n\phi_q) \end{aligned} \tag{A.4}$$

where $$\epsilon_n = \sqrt{2 - \delta_{n-0}} = \begin{cases} 1, & \text{if } n = 0, \\ \sqrt{2}, & \text{otherwise} \end{cases} \tag{A.5}$$

More generally, any sound field due to waves impinging from directions $0\le\phi\le\pi$ (and that satisfies the homogeneous Helmholtz equation in the half-space y>0) and the corresponding scattered and total field in the presence of a rigid plane y=0 can be represented as:

$$p_1(r, \phi, z) = \sum_{n=-\infty}^{\infty} e^{in\phi} \frac{1}{2\pi} \int_{-\infty}^{\infty} e^{ik_z z} J_n(k_r r) C_n(k_z) dk_z \tag{A.6}$$

$$p_2(r, \phi, z) = \sum_{n=-\infty}^{\infty} e^{-in\phi} \frac{1}{2\pi} \int_{-\infty}^{\infty} e^{ik_z z} J_n(k_r r) C_n(k_z) dk_z \tag{A.7}$$

$$\begin{aligned} p(r, \phi, z) = p_{1+} p_2 &= \sum_{n=-\infty}^{\infty} (e^{in\phi} + e^{-in\phi}) \frac{1}{2\pi} \int_{-\infty}^{\infty} e^{ik_z z} J_n(k_r r) C_n(k_z) dk_z \\ &= \sum_{n=0}^{\infty} \epsilon_n \cos(n\phi) \frac{1}{2\pi} \int_{-\infty}^{\infty} e^{ik_z z} J_n(k_r r) D_n(k_z) dk_z \end{aligned} \tag{A.8}$$

where $$D_n(k_z) = \epsilon_n [C_n(k_z) + (-1)^n C_{-n}(k_z)] \tag{A.9}$$

For a plane wave impinging from $\phi_q$, $\theta_q$ this is given by:

$$\begin{aligned} D_n(k_z) &= \epsilon_n 2\pi\delta(k_z - k\cos\theta_q)[i^{-n} e^{-in\phi_q} + (-1)^n i^n e^{in\phi_q}] \\ &= \epsilon_n 2\pi\delta(k_z - k\cos\theta_q) i^{-n} 2\cos(n\phi_q) \end{aligned} \tag{A.10}$$

Now, the problem of scattering of a field due to waves impinging from directions $0\le\phi\le\pi$ is studied for a half rigid infinite cylinder being placed on a rigid wall, as in FIG. 9. To that end a modified Green function is used. The Green function of the Helmholtz equation that satisfies the Neumann boundary condition (A.1) is given by a free field Green function plus its image source, that is:

$$G_W(r', r) = \frac{e^{ik|r'-r|}}{4\pi|r'-r|} + R\frac{e^{ik|r'-r_M|}}{4\pi|r'-r_M|} \tag{A.11}$$

where $R=\sqrt{1-\alpha}$ is the reflection factor (a is the absorption coefficient), hereafter assumed to be unitary (perfectly reflecting wall), and $$r=[r\cos\phi, r\sin\phi, z]$$

$$r_M=[r\cos\phi, -r\sin\phi, z] \tag{A.12}$$

In the presence of a scatterer with boundary S, the scattered field can be represented by a modified single layer potential:

$$p_s(r) = \int_S G_W(r, r') u(r') dS(r') \tag{A.13}$$

with $$\frac{\partial p_s(r)}{\partial n} = -\frac{\partial p_i(r)}{\partial n},\ r \in S \tag{A.14}$$

For the case under consideration $S=\{r: |r|=R, 0\le\phi\le\pi\}$, that is the surface of the rigid hemi-cylinder. In this case the scattered field can be regarded as the field generated by a radiating cylinder with a vibration pattern symmetrical with respect to the plane y=0 and can be therefore expressed by means of the following series of cosines and Hankel functions:

$$p_s(r, \phi, z) = \sum_{n=0}^{\infty} \epsilon_n \cos(n\phi) \frac{1}{2\pi} \int_{-\infty}^{\infty} e^{ik_z z} H_n(k_r r) A_n(k_z) dk_z \tag{A.15}$$

Applying the Neumann boundary condition on the surface of the rigid hemi-cylinder one obtains:

$$\begin{aligned} 0 &= \frac{\partial}{\partial r}[p_i(r, \phi, z) + p_s(r, \phi, z)]\Big|_{r=R} \\ &= \frac{\partial}{\partial r} \sum_{n=0}^{\infty} \epsilon_n \cos(n\phi) \frac{1}{2\pi} \int_{-\infty}^{\infty} e^{ik_z z} [J_n(k_r R) D_n(k_z) + H_n(k_r R) A_n(k_z)] dk_z \end{aligned} \tag{A.16}$$

which yields:

$$A_n(k_z) = -\frac{J_{n'}(k_r R)}{H_{n'}(k_r R)} D_n(k_z) \tag{A.17}$$

If the field is evaluated on the boundary of the scatterer, that is at r=R, the Wronskian relation $H_n(\xi)J_n(\xi)-H_n(\xi)J_{n'}(\xi)=i2/(\pi\xi)$ can be used, thus obtaining the following expression for the total (incident+scattered) field:

$$p(R, \phi, z) = \sum_{n=0}^{\infty} \epsilon_n \cos(n\phi) \frac{1}{2\pi} \int_{-\infty}^{\infty} e^{ik_z z} \frac{i2}{\pi k_r R\ H_{n'}(k_r R)} D_n(k_z) dk_z \tag{A.18}$$

The function $b_n(\xi)$ is defined as follows:

$$b_n(\xi) = \frac{i2}{\pi\xi\ H_{n'}(\xi)} \tag{A.19}$$

For a plane wave impinging from $\phi_q$, $\theta_q$, combining the results above with equation (A.10) the following final result is obtained:

$$\begin{aligned} p(R, \phi, z) &= G_{NF}(R, \phi, z, \theta_q, \phi_q) = \\ & e^{ik_z \cos\theta_q} \sum_{n=-\infty}^{\infty} [e^{in(\phi+\phi_q)} + e^{in(\phi-\phi_q)}] i^{-n} b_n(kR\sin\theta_q) = \\ & e^{ik_z \cos\theta_q} \sum_{n=0}^{\infty} \epsilon_n^2 2\cos(n\phi)\cos(n\phi_q) i^{-n} b_n(kR\sin\theta_q) \end{aligned} \tag{A.20}$$

This is the radiation pattern of a transducer located on the rigid hemi-cylinder at location R, $\phi$, z. Evaluating this result for z=0 (i.e. for $\theta_q=\pi/2$) and comparing with equation (7) one obtains:

$$\Gamma_n = 2i^{-n} b_n(kR) \tag{A.21}$$

Secondly, the mathematical formulae defining the signal processing blocks for synthesizing a far-field radiation pattern $f(\phi)$, as given by equation (8) with a sub-array of L uniformly spaced transducers are derived.

The spatial spectrum of the target radiation pattern is chosen to be frequency independent and limited to the order N=L−1. Recalling that $$\phi_l = \left(l + \frac{1}{2}\right)\pi / L,$$

one obtains that:

$$\begin{aligned} f(\phi) &= \sum_{\ell=0}^{L-1} G_{NF}(R, \phi_\ell, 0, \pi/2, \phi, \omega) q_\ell(\omega) \\ &= \sum_{n=0}^{\infty} \epsilon_n \cos(n\phi) \Gamma_n(\omega) \sum_{\ell=0}^{L-1} \epsilon_n \cos[n(\ell + 1/2)\pi/L) q_\ell(\omega) \\ &= \sum_{n=0}^{\infty} \epsilon_n \cos(n\phi) \Gamma_n(\omega) Q_n(\omega) \end{aligned} \tag{A.22}$$

where $q_l(\omega)$ is the signal of the l-th transducer represented in the frequency domain and for unitary input signal, i.e. $x(t)=\delta(t)$, and $Q_n(\omega)$ are the coefficients of its discrete cosine transform. The two following relations hold true:

$$\begin{aligned} q_\ell(\omega) &= \frac{1}{L} \sum_{n=0}^{L-1} \epsilon_n \cos[n(\ell + 1/2)\pi/L] Q_n(\omega) \\ Q_n(\omega) &= \sum_{\ell=0}^{L-1} \epsilon_n \cos[n(\ell + 1/2)\pi/L] q_\ell(\omega) \end{aligned} \tag{A.23}$$

Both sides of equation (A.22) are multiplied by $\grave{o}_m \cos(m\phi)/\pi$ and integrated between 0 and $\pi$, thus obtaining:

$$\begin{aligned} &\frac{1}{\pi} \int_0^{\pi} f(\phi) \epsilon_m \cos(m\phi) d\phi = \\ &\qquad \sum_{n=0}^{\infty} \Gamma_n(\omega) Q_n(\omega) \frac{1}{\pi} \int_0^{\pi} \epsilon_n \cos(n\phi) \epsilon_m \cos(m\phi) d\phi \end{aligned} \tag{A.24}$$

which yields:

$$f_m = \Gamma_m(\omega) Q_m(\omega),\ m < L \tag{A.25}$$

and $$q_\ell(\omega) = \frac{1}{L} \sum_{n=0}^{L-1} \epsilon_n \cos[n(\ell + 1/2)\pi/L] \frac{f_n}{\Gamma_n(\omega)} \tag{A.26}$$

This approach provides an exact result only if the contribution of the order n≥L in equation (7) is negligible. Otherwise, the reproduced radiation pattern will be affected by spatial aliasing. The regularized version of equation (A.26) is computed using equation (15) and is given by:

$$q_\ell(\omega) = \frac{1}{L} \sum_{n=0}^{L-1} \epsilon_n \cos[n(\ell + 1/2)\pi/L] R_n(\omega) f_n \tag{A.27}$$

Applying the inverse Fourier transform to this result and convolving it with x(t) yields equation (16). A possible choice for the radiation pattern is given by equations (8) and (9). This pattern corresponds to an order-truncated spatial Dirac delta function. The constant $\gamma(\phi_0)$ may be chosen so that $f(\phi_0)=1$ and is therefore given by equation (10). Combining all results above we obtain:

$$q_\ell(\omega) = \frac{1}{L}\sum_{n=0}^{L-1} \epsilon_n^2 \cos[n(\ell + 1/2)\pi / L] R_n(\omega)\gamma(\phi_0)\cos(n\phi_0) \tag{A.28}$$

whose inverse Fourier transform and convolution by x(t) yields an equation, which can be rewritten as:

$$z_\ell(t) = \sum_{n=0}^{L-1} [x(t) \otimes R_n(t)] G_{n,\ell}(\phi_0) \tag{A.29}$$

This is the mathematical representation of the signal processing scheme illustrated in FIGS. 10 to 12.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the disclosure beyond those described herein. While the present disclosure has been described with reference to one or more particular embodiments, those skilled in the art recognize that many changes may be made thereto without departing from the scope of the present disclosure. It is therefore to be understood that within the scope of the appended claims and their equivalents, the disclosure may be practiced otherwise than as specifically described herein.

What is claimed is:

1. An audio signal processing apparatus for processing an input audio signal, the audio signal processing apparatus comprising:

a plurality of filters, each filter configured to filter the input audio signal to obtain a plurality of filtered audio signals, each filter designed according to an extended mode matching beamforming applied to a surface of a half revolution, the surface partially characterizing a loudspeaker enclosure shape;

a plurality of scaling components, each scaling component configured to scale the plurality of filtered audio signals using a plurality of gain coefficients to obtain a plurality of scaled filtered audio signals; and a plurality of adders, each adder configured to combine the plurality of scaled filtered audio signals, so as to provide an output audio signal for producing a sound field having a beam directivity pattern defined by the plurality of gain coefficients;

wherein the impulse response of an n-th filter of the plurality of filters is obtained through the following:

$$R_n(t) = F^{-1}\left[\frac{1}{\Gamma_n(r, \omega)}\right],$$

wherein $F^{-1}$ denotes the inverse Fourier transformation, $\Gamma_n$ characterizes, as a function of radial distance r and frequency ω, an n-th order coefficient of a Fourier series describing a radiation polar pattern of a transducer array conforming to the curvature of a surface of a full revolution comprising the surface of the half revolution, the n-th order coefficient is dependent on the loudspeaker enclosure shape, and $R_n(t)$ denotes the impulse response of the n-th filter as a function of time.

2. The audio signal processing apparatus of claim 1, wherein the impulse response of the n-th filter is obtained through the following:

$$R_n(t) = F^{-1}\left[\frac{\Gamma_n(r, \omega)^*}{|\Gamma_n(r, \omega)|^2 + \beta_n(\omega)}\right],$$

wherein $\beta_n$ denotes a definable regularization parameter.

3. The audio signal processing apparatus of claim 1, wherein $\Gamma_n$ is obtained through the following:

$$\Gamma_n = 2i^{-n} b_n(kR),$$

wherein the function $b_n(kR)$ is obtained through the following:

$$b_n(\xi) = \frac{2i}{\pi\xi H_n'(\xi)},$$

wherein ξ denotes the product kR, k denotes the wave number, R denotes the radius of the surface of the half revolution and $H_n'$ denotes a derivative of the n-th order Hankel function.

4. The audio signal processing apparatus of claim 1, wherein the output audio signal for the l-th transducer of the transducer array is obtained through the following:

$$z_l(t) = E_{n=0}^{L-1}[x(t) \otimes R_n(t)] G_{n,l},$$

wherein $z_l(t)$ denotes the output signal as a function of time, x(t) denotes the input audio signal as a function of time, ⊗ denotes the convolution operator, where n can range from 0 to N and N depends on the beam directivity pattern, and $G_{n,l}$ denotes the n-th gain coefficient for the l-th transducer.

5. The audio signal processing apparatus of claim 4, wherein the n-th gain coefficient for the l-th transducer of the transducer array is obtained through the following:

$$G_{n,l} = \frac{\sqrt{2-\delta_n}}{L}\cos(n\phi_l)f_n,$$

wherein $\delta_n$ denotes the Kronecker delta being equal to 1 if n=0 and equal to 0 otherwise, L denotes the number of transducers of the transducer array, $\phi_l$ denotes the angular coordinate that identifies the position of the l-th transducer of the transducer array and $f_n$ characterizes the n-th coefficient of the Fourier series or Fourier cosine series describing a desired beam directivity pattern as a function of the radiation angle.

6. The audio signal processing apparatus of claim 5, wherein the beam directivity pattern is a single beam in a direction defined by an angle $\phi_0$ and wherein the n-th directivity coefficient $f_n$ is obtained through the following:

$$f_n=\sqrt{2-\delta_n}\gamma(\phi_0)\cos(n\phi_0),$$

wherein $\gamma(\phi_0)$ is an angular dependent factor obtained through the following:

$$\gamma(\phi_0) = \frac{1}{\sum_{n=0}^{N}(2-\delta_n)\cos(n\phi_0)^2}.$$

7. The audio signal processing apparatus of claim 4, wherein the beam directivity pattern is defined by multiple beams in respective directions defined by a respective angle $\phi_j$ and wherein the output audio signal $z_l(t)$ for the l-th transducer of the transducer array is obtained through the following:

$$z_l(t)=\Sigma_{n=0}^{L-1}\Sigma_{j=1}^{J}[x(t)\otimes R_n(t)\otimes\delta(t-\tau_j)K_j]G_{n,l}(\phi_j),$$

wherein J denotes the total number of beams of the beam directivity pattern, $\tau_j$ denotes the time delay for the j-th beam and $K_j$ denotes the gain for the j-th beam.

* * * * *